US005839043A

United States Patent [19]

Okabayashi et al.

[11] Patent Number: 5,839,043

[45] Date of Patent: Nov. 17, 1998

[54] THERMAL FIXING APPARATUS AND INDUCTIVELY HEATED SLEEVE

[75] Inventors: Eiji Okabayashi; Taizou Oonishi, both of Toyokawa, Japan

[73] Assignee: Minolta Co., Ltd., Osaka, Japan

[21] Appl. No.: 707,688

[22] Filed: Sep. 4, 1996

[30] Foreign Application Priority Data

| | | | |
|---|---|---|---|
| Sep. 4, 1995 | [JP] | Japan | 7-226769 |
| Nov. 30, 1995 | [JP] | Japan | 7-312845 |
| Jan. 16, 1996 | [JP] | Japan | 8-004852 |
| Aug. 22, 1996 | [JP] | Japan | 8-221512 |

[51] Int. Cl.[6] ..... G03G 15/20

[52] U.S. Cl. ..... 399/329; 219/216

[58] Field of Search ..... 399/328, 329, 399/331; 219/216, 601, 619, 635, 672

[56] References Cited

U.S. PATENT DOCUMENTS

| | | | |
|---|---|---|---|
| 4,570,044 | 2/1986 | Kobayashi et al. | 219/619 |
| 5,149,941 | 9/1992 | Hirabayashi et al. . | |
| 5,262,834 | 11/1993 | Kusaka et al. | 399/329 |
| 5,278,618 | 1/1994 | Mitani et al. | 399/329 |
| 5,506,666 | 4/1996 | Masuda et al. | 399/335 |
| 5,526,103 | 6/1996 | Kato et al. | 399/328 |
| 5,552,582 | 9/1996 | Abe et al. | 219/619 |
| 5,568,235 | 10/1996 | Amarakoon | 399/319 |
| 5,568,240 | 10/1996 | Ohtsuka | 399/335 |

FOREIGN PATENT DOCUMENTS

| | | |
|---|---|---|
| 0649072A1 | 4/1995 | European Pat. Off. . |
| 59-033787A | 2/1984 | Japan . |
| 04291384A | 10/1992 | Japan . |
| 05066688A | 3/1993 | Japan . |

*Primary Examiner*—Robert Beatty
*Attorney, Agent, or Firm*—McDermott, Will & Emery

[57] ABSTRACT

An induction heating type fixing apparatus comprises a fixing sleeve formed of a flexible thin electrically conductive magnetic material, a coil for producing an induced eddy current in the fixing sleeve to generate heat therein, a holder adapted to retain the coil and disposed stationarily in the fixing sleeve, and a pressing roller pressed against the holder through the fixing sleeve. A sheet carrying thereon an unfixed toner is conveyed as nipped between the fixing sleeve and the pressing roller. The toner on the sheet is melted by the heat of the sleeve itself and exposed to the pressure exerted between the holder and the pressing roller and fixed on the sheet. The holder is provided with a separating member adapted to effect the curvature separation of the sheet from the fixing sleeve. The holder is further provided with a heat-diffusing member made of a material with good thermal conductivity characteristics and non-magnetic properties.

18 Claims, 18 Drawing Sheets

THERMAL FIXING APPARATUS AND INDUCTIVELY HEATED SLEEVE

BACKGROUND OF THE INVENTION

1. Field of the Invention

This invention relates to a fixing apparatus for use in such image forming devices as electrophotographic copying devices, printers, and facsimile devices and more particularly to a fixing apparatus for thermally fusing a toner retained on a sheet thereby fixing the toner on the sheet, and to a sleeve for use in the fixing apparatus.

2. Description of the Related Art

The electrophotographic copying device, for example, is provided with a fixing apparatus which serves to fuse thermally a toner image deposited by transfer onto the sheet of a recording paper or a transfer paper as a recording medium and fix the toner image on the sheet. This fixing apparatus is possessed of a fixing roller for thermally fusing the toner on the sheet and a pressing roller adapted to be pressed against the fixing roller and consequently enabled to nip the sheet in cooperation therewith, for example. The fixing roller is formed in the shape of a hollow cylinder and provided on the axis of the cylinder with a heat source fixed in place with retaining means. This heat source is disposed on the axis of the fixing roller. The heat emitted by the heat source uniformly irradiates the inner wall of the fixing roller and the temperature distribution on the outer wall of the fixing roller, therefore, is uniform in the circumferential direction. The outer wall of the fixing roller is heated until the temperature thereof reaches a level (150°~200° C., for example) that fits the fixation. The fixing roller and the pressing roller in the posture described above rotate in mutually opposite directions while remaining in mutually sliding contact and nipping therebetween the sheet carrying the toner thereon and convey it. In the sliding parts of the fixing roller and the pressing roller (hereinafter referred to as "nipping parts"), the toner on the sheet is melted by the heat of the fixing roller and fixed on the sheet by the pressure exerted thereon by the two rollers. After the toner has been fixed, the sheet is forwarded by the rotations of the fixing roller and the pressure roller to the paper discharging roller, which further conveys the sheet and ultimately discharged onto a paper discharge tray.

In the fixing apparatus of the structure described above, a tungsten halogen lamp is generally used as the heat source. This fixing apparatus, therefore, requires a relatively long duration to intervene between the time that the power source is turned on and the time that the temperature of the fixing roller reaches the level fit for the fixation aimed at. In this while, the user of the copying device is prevented from quickly utilizing it and forced to endure a long wait. When the heat quantity of the fixing roller is increased for the purpose of curtailing the waiting time and ensuring the user's quick print, the power consumption in the fixing apparatus is enlarged contrary to the principle of energy conservation.

For enhancing the worth of copying devices as articles of commerce, therefore, the necessity of simultaneously satisfying the energy conservation (decrease of the power consumption) in the fixing apparatus and the improvement of the user's convenience (quick print) has come to attract growing attention as a matter of great significance. It has become necessary, as a result, to strive not only to lower the fixing temperature of the toner and the thermal capacity of the fixing roller from the conventional levels but also to promote the improvement of the thermo-electric conversion efficiency.

As means to satisfy this harsh demand, fixing apparatuses which resort to the principle of induction heating have been proposed. JP-A-S59-33,787, for example, discloses a structure which has disposed inside a roller made of a metallic conductor, an open magnetic circuit iron core having a coil spirally wound thereon. In this fixing apparatus, the coil that approximates closely to the inner surface of the roller is caused to generate a high frequency magnetic field by having a high frequency current to flow therethrough and the roller is directly caused by this high frequency magnetic field to generate an induced eddy current and the roller is caused by the skin resistance of its own to generate Joule heat.

The induction heating of this nature has the following advantages as compared with the other heating methods.

Firstly, the induction heating elevates the temperature quickly and suffers the parts other than the fixing roller to generate heat or conduct heat only sparingly as compared with the indirect heating like the near infrared ray heating with a tungsten halogen lamp. It does not incur such loss as corresponds to the leakage of light from the tungsten halogen lamp. Secondly, the induction heating enjoys a high lasting reliability of the operation of the fixing apparatus owing to the absence of a sliding contact as compared with the surface heating system that resorts to a solid resistance heat source provided on a fixing roller. Thirdly, the induction heating possesses an outstanding ability to control temperature because it incurs only sparing loss of thermal conduction and permits easy detection of the temperature on the heat generating surface as compared with the heating that utilizes a film belt and a solid resistance heat source.

U.S. Pat. No. 5,149,941 discloses an image forming apparatus which is adapted to fix a toner image on a recording medium by causing the recording medium held in tight contact with a heat-resistant film made of polyester to be moved between a stationary heat source and a pressing roller disposed opposite the heat source. The apparatus disclosed in this patent publication attains an object of curtailing warming-up time and promoting energy conservation by using a heat source that relies on the pulse conduction of electric current to effect instantaneous emission of heat and enabling a toner carried on a recording medium opposed to the heat source across a heat-resistant film to be melted and fixed on the recording medium by the heat from the heat source.

The conventional techniques described above have the following problems of their own.

When the heating method disclosed in JP-A-S59-33,787 is applied for a heating roller (fixing roller) in a standard roller fixing apparatus, since the fixing roller adapted to produce a pressing force in cooperation with a pressing roller is destined to be heated in itself, an attempt to decrease further the power consumption in the apparatus necessitates a decrease in the heat capacity of the fixing roller or a decrease in the section thickness of the fixing roller itself. Since the fixing roller functions to produce the pressing force, it requires to possess a certain degree of strength. An appreciable decrease in the section thickness of the fixing roller, therefore, is not quite feasible on account of the structure.

In the fixing apparatus disclosed in U.S. Pat. No. 5,149,941, since the heat-resistant film intervenes between the heat source and the recording medium, the thermal resistance due to the contact between the heat-resistant film and the heat source and the thermal resistance of the heat-resistant film itself exist between the heat source and the recording medium. In the presence of these thermal resistances, the heat source requires to have a temperature higher than the temperature that is necessary for fixing the toner on the recording medium and this emission of heat entails a proportionate loss of energy. When the heat-resistant film is formed with such a resinous material as polyester, since the surface of the resinous material has a high magnitude of heat emissivity, the resin accumulates heat and, consequently, radiates a large quantity of heat and entails a waste of electric powder. For the purpose of lowering the thermal resistance and decreasing the capacity for heat accumulation in the heat-resistant film of such nature, the heat-resistant film itself requires to be formed in a small section thickness. An excessive decrease in the film thickness, however, entails the problem that the heat-resistant film will lose durability and readily succumb to fracture.

Incidentally, in the roller fixing apparatus, since the sheet discharged from the nipping part is liable to adhere to the peripheral surface of the heating roller in consequence of the fusion of the toner in the process of fixture, the sheet must be separated or peeled from the heating roller before the paper discharging roller discharges the sheet. As structures for effecting the separation of the sheet from the heating roller, those utilizing a separation claw adapted to keep the leading end part thereof in sliding contact the surface of a heating roller and those resorting to the curvature separation utilizing the stiffness of the sheet have been known to date.

When a roller of a relatively small diameter is used as the heating roller, since the heating roller has a small radius of curvature, the strength of the sheet alone suffices for thorough separation of the sheet from the heating roller. Since the curvature separation of this nature has no use for the separation claw, it is at an advantage in attaining the separation of the sheet with a simple structure at no sacrifice of the service life of the heating roller.

In proportion as the number of pages to be printed or the operating speed of the printer increases per unit time, it becomes necessary to increase the outside diameter of the heating roller for securing amply the nip width for heating paper. When a roller of a relatively large diameter is adopted as the heating roller as observed in such high-speed printers as mentioned above, since the heating roller has such a large radius of curvature as renders infeasible the separation of the sheet by means of the curvature even if the peripheral surface of the heating roller is coated with a release layer capable of facilitating the separation of the sheet, the use of a separating claw has been an unavoidable necessity. In the structure of separation utilizing the separation claw, the heating roller tends to sustain flaws such as scratches on the peripheral surface thereof and suffer from consequent degradation of durability and, owing to the flaws, incur such adverse phenomena as disruption of images to be formed thereon.

Among the conventional fixing apparatuses, therefore, is found the apparatus which, as disclosed in JP-A-H04-291, 384, is adapted to press a separation claw against the heating roller in concert with the discharge of the sheet from the nipping part and keep the separation claw apart from the heating roller at any other point of time.

In the fixing apparatus which is so constructed as to make and break contact freely between the separation claw and the heating roller as disclosed in the patent publication, the elongation of the service life of the heating roller has its own limit because the occurrence of such flaws as scratches cannot be radically precluded owing to the presence of the separation claw.

Further, this fixing apparatus suffers from complication of design because it necessitates a mechanism for separating this separation claw from the heating roller besides the separation claw itself. An attempt to miniaturize the fixing apparatus and consequently the image forming apparatus, therefore, is inhibited and suffered to incur an addition to the cost.

In the induction heating type fixing apparatus, a metallic conductor functions as a heating element. Since the quick print can be realized by decreasing the heat capacity of this heating element and consequently curtailing the preheating time, the idea of decreasing the section thickness of the metallic conductor is not infeasible.

The decrease in the section thickness of the metallic conductor, however, leads eventually to practical loss of the thermal conduction in the longitudinal direction of the metallic conductor.

In the case of the mode of continuous supply of sheets of a size smaller than the maximum width of passage which frequently occurs as in a copying apparatus, therefore, the temperature of the metallic conductor in a paper non-contacting area which is not positioned on the passage of paper rises above the adjustable range of temperature and the difference between the temperature in a paper passing area which is positioned on the passage of paper and the temperature in the paper non-contacting area enlarges extremely. This uneven temperature distribution in the longitudinal direction of the metallic conductor has the possibility of degrading the peripheral components made of a resinous material in the ability to resist heat and suffering the peripheral components to sustain thermal damage. When the supply of sheets of a larger size is started immediately after the mode, the problem arises that the passage of these sheet will induce the so-called high-temperature offset, i.e. the local loss of evenness of the fixing property.

Incidentally, these problems are not peculiar to the fixing apparatus of the principle of induction heating that utilizes thin metallic elements capable of generating heat. Even in the fixing apparatuses which use a thin heating element adapted to be heated by a heat source and disposed so as to be moved freely in the direction of conveyance of a sheet, the rise of the temperature of the heating element in the paper non-contacting area generally entails such problems as conspicuous disruption of the even temperature distribution in the longitudinal direction of the thin heating element, degradation of the ability of the peripheral components to resist heat, and the high-temperature offset.

The fixing apparatus, therefore, requires to curb the uneven temperature distribution in the longitudinal direction of the thin heating element while fulfilling the demand for the quick print. Since the trend of the heating element toward the temperature rise in the paper non-contacting area is notably varied by the number of sheets to be continuously passed and the size of sheets to be passed, the fixing apparatus is demanded to repress the uneven temperature contribution in spite of possible changes in the condition for the use of the fixing apparatus.

SUMMARY OF THE INVENTION

An object of this invention is to provide an improved thermal fixing apparatus which is liberated from the various problems.

A further object of this invention is to provide a thermal fixing apparatus which quickly rises to a temperature necessary for the purpose of fixture aimed at and features a small power consumption.

Another object of this invention is to provide a thermal fixing apparatus which permits infallible separation of a sheet discharged from a fixing nipping part without requiring the use of a separation claw and allows high-speed formation of an image.

Yet another object of this invention is to provide a thermal fixing apparatus which allows effective prevention of the uneven temperature distribution in the longitudinal direction of a heating element for a sheet, namely the direction perpendicular to the direction of conveyance of a sheet, and further enables the prevention of the uneven temperature distribution to be stably continued in spite of the condition of paper passage.

This invention concerns a fixing apparatus for thermally fusing a toner deposited on a sheet thereby fixing the toner on the sheet and specifically a thermal fixing apparatus which has a short warm-up period and a small power consumption. This fixing apparatus comprises;

- a thin sleeve with flexibility composed of a base layer and a surface layer, at least one of said layers or said surface layer made of metal,
- a sleeve formed of a flexible thin metallic material;
- a coil adapted to generate a magnetic field in response to a high-frequency current supplied thereto and, with the magnetic field, produce an induced eddy current in the sleeve to generate heat therein,
- a holder adapted to retain the coil and stationarily disposed inside the sleeve; and
- a rotatable cylindrical pressing roller pressed against the holder through the sleeve and adapted to nip a sheet carrying an unfixed toner thereon in cooperation with the sleeve and move the sheet in conjunction with the sleeve. The sleeve is disposed not stationarily and allowed to contact the holder exclusively in the part in which it is pressed by the pressing roller.

In the fixing apparatus, the flexible sleeve is moved as nipped between the holder and the pressing roller and the sheet carrying the unfixed toner thereon is conveyed as nipped between the sleeve and the pressing roller. At least one of the layers or the surface layer of the sleeve suffers an induced eddy current generated by the coil and directly undergoes induction heating. The toner on the sheet is melted by the heat of the surface layer's own generation of the sleeve and further exposed to the pressure exerted thereon between the holder and the pressure roller and consequently fixed on the sheet. In the structure of this description, since the sleeve is allowed to decrease its heat capacity as a whole by decreasing at least the section thickness of the surface layer as the heating element, the warm-up period for raising the temperature of this sleeve to a level necessary for the fixture and, accordingly, power consumption can be curtailed. Moreover, since the present thermal fixing apparatus obviates the necessity for a heat-resistant sheet which is prone to the problem of thermal resistance, it attains quick warm-up at a small power consumption and contributes to energy conservation as compared with the method which effects the heating through a heat-resistant film.

The holder has an endless cross section like that of a cylinder and the coil causes the sleeve to produce an induced eddy current and consequently generate heat in at least two different areas in the circumferential direction thereof.

The base layer of the sleeve is preferably formed of metal. Because a metallic material as the base layer radiates heat in a lower amount than, for example, a heat-resisting film formed of resin, and thus cannot waste electric power.

The coil is formed around a core made of a magnetic material which is disposed parallel to the direction of conveyance of the sheet. The core has a shape of the letter I and an end face of the core in a longitudinal direction of its cross section is disposed closely to the inner wall of the holder. One of the areas of heat generation of the sleeve and the nipping part are overlapped at least partly. As a result, the heat of the sleeve may be sufficiently transferred to the toner without a heat loss. In addition, the transmission of electric power is attained at a high efficiency because an air gap between the core and the sleeve is narrowed and the magnetic attachment of the core with the sleeve is strengthened.

It is preferable that a bobbin with heat-resisting and insulating properties for winding the coil thereon is disposed between the coil and the core.

The pressing roller may be substituted by a freely revolving endless belt which is passed around two pulleys and adapted to be pressed against the holder through the sleeve.

Preferably, the part of the holder which is depressed by the pressing roller is formed in a concave shape substantially in mesh with the surface profile of the pressing roller.

This setup widens the nipping part, i.e. the part in which the sleeve and the pressing roller produce a sliding contact with each other, and consequently enlarges the surface area of contact between the sleeve and the sheet (the area in which they are in intimate contact). Since the heat from the sleeve is thoroughly transferred to the toner as a result, the temperature set for the sleeve can be lowered to the extent of further promoting the energy conservation.

The sleeve to be used in the present fixing apparatus has a thickness in the range of 20 $\mu$m~60 $\mu$m and is enabled by the magnetic field generated by the coil to produce an induced eddy current and consequently generate heat. Appropriately, the sleeve is formed of such an electrically conductive magnetic material as iron, nickel, or SUS430.

In one embodiment of this invention, the fixing apparatus is further provided with a separating member of an arcuate cross section having a radius of curvature proper for the curvature separation of the sheet from the sleeve. This separating member is provided on the holder. The separating member is installed inside the sleeve and adapted to press the sleeve outwardly.

In this fixing apparatus, the sleeve deforms in conformity with the separating member of an arcuate cross section and gives rise to a separating part possessed of a radius of curvature practically equal to the radius of curvature of the separating member. The sheet discharged from the nipping part, therefore, infallibly assumes a state capable of curvature separation while coming into contact with the sleeve. It is separated from the sleeve exclusively by the curvature separation which resorts to the stiffness of the sheet. Even when the holder has a large outside diameter as usually observed in a high-speed device, the stiffness of the sheet alone suffices for effecting perfect curvature separation of the sheet from the sleeve so long as the radius of curvature of the separating member is set at an appropriate value. This fixing apparatus, despite the very simple structure issuing from the incorporation of the separating member of an arcuate cross section, infallibly separates the sheet without using a separating claw even when it happens to be incorporated in an image forming apparatus designed to be operated at a high speed. Thus, the sleeve enjoys an elongation of its service life because the possibility that the sleeve will sustain such flaws as scratches on the peripheral surface thereof is completely eliminated. The possibility that the produced images will be disrupted by the flaws on the sleeve, therefore, can be precluded. The fixing apparatus further excels in terms of cost because it obviates the necessity for a separating claw and a mechanism for moving the separating claw into contact with the sleeve and accordingly saves the cost otherwise incurred for these devices. The elimination of these mechanisms and members results in simplifying the structure of the fixing apparatus and allowing miniaturization of the fixing apparatus and further enabling an image forming apparatus to be proportionately miniaturized.

Preferably, the separating member is disposed on the downstream side of the nipping part relative to the direction of conveyance of sheet.

When the separating member is installed at this position, it accomplishes the separation of the sheet from the sleeve advantageously without requiring the use of a separating claw.

Preferably, the separating member is disposed on the downstream side of the nipping part relative to the direction of conveyance of sheet at a position where the angle θ formed between the normal in the nipping part and the normal at the point of separation of the sheet from the separating member falls in the range, $17° \leqq \theta \leqq 45°$.

When the separating member is installed in the range specified above, the inclination of the sheet in the direction of its discharge can be retained within an angle in which the operation of discharging the sheet as by the discharge roller can be attained without any obstruction.

In another embodiment of this invention, the fixing apparatus is further provided with a heat-diffusing member which is extended in a direction perpendicular to the direction of conveyance of sheet and made of a non-magnetic material with good thermal conductivity characteristics. This heat-diffusing member is disposed on the holder. The heat-diffusing member is installed inside the sleeve so as to contact the sleeve in the nipping part.

In this fixing apparatus, when the coil is energized, the heat-diffusing member which is made of a non-magnetic material does not easily generate an induced current and hardly emits heat, while the sleeve generates an induced current and emits heat. Since the heat-diffusing member which contacts the sleeve is made of a material with good thermal conductivity characteristics, the conduction of heat in the sleeve in the longitudinal direction thereof is improved and the conduction of heat in the sleeve in the longitudinal direction thereof is facilitated. Even in the mode of continuous supply of recording media of a size smaller than the maximum width of passage, therefore, the heat of the paper non-contacting area is conducted through the heat-diffusing member to the paper contacting area and the difference between the temperature of the sleeve in the paper contacting area and the temperature in the paper non-contacting area decreases. Thus, the rise of temperature in the paper non-contacting area is diminished and the uneven temperature distribution of the sleeve in the longitudinal direction is consequently repressed. As a result, the possibility that the ability of the peripheral components made of a resinous material to resist heat will be degraded and the peripheral components will sustain thermal damage is eliminated. Further, even when the supply of sheets of a large size is started immediately after the mode, the evenness of the fixing property will not be locally disrupted and the fixing property will be infallibly obtained stably in spite of the condition of passage of paper.

Preferably, the fixing apparatus is further provided with a second heat-diffusing member having smaller thermal conductivity than the heat-diffusing member and a control device for selectively switching the positions of the first and the second heat-diffusing member so as to enable either of the first and the second heat-diffusing member to contact the sleeve in the nipping part. The second heat-diffusing member is also disposed on the holder.

In this fixing apparatus, the selective switch of the positions of the first and the second heat-diffusing member allows the heat-diffusing members possessed of different thermal conductivity selectively to confront the nipping position. A change in the condition of use of the fixing apparatus varies the trend of the material under heat treatment toward the rise of temperature in the paper non-contacting area. By enabling the heat-diffusing members to confront the nipping position selectively to suit the occasion, the uneven temperature distribution in the longitudinal direction of the sleeve under heat treatment can be advantageously curbed proportionately to the change in the condition of use of the fixing apparatus.

The control device switches the positions of the first and the second heat-diffusing member on the basis of the temperature of the sleeve, the number of sheets to be continuously passed, or the size of sheets. When the temperature of the sleeve forms the basis for the operation of the control device, for example, the control device keeps the second heat-diffusing member of smaller thermal conductivity at the nipping position until the warm-up of the sleeve is completed. It sets the first heat-diffusing member of larger thermal conductivity at the nipping position after the warm-up of the sleeve is completed.

DETAILED DESCRIPTION OF THE PREFERRED EMBODIMENTS

Now, the fixing apparatuses according to embodiments of this invention will be described below with reference to the accompanying drawings.

First Embodiment

Figure 1:
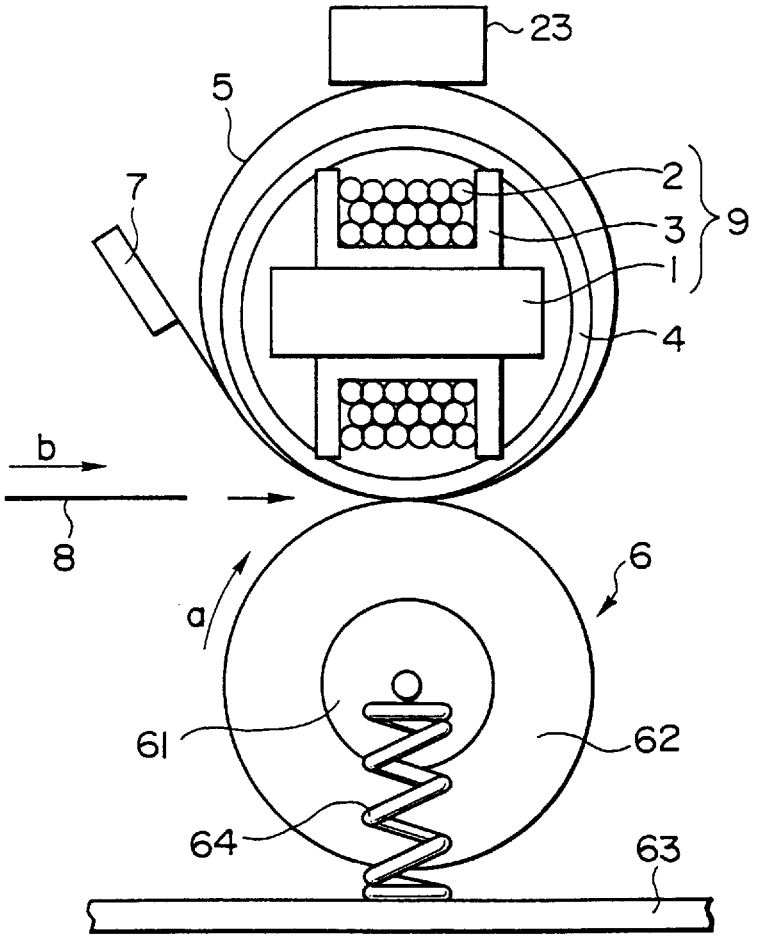
FIG. 1 is a structural diagram illustrating an induction heating type fixing apparatus in the first embodiment of this invention.
Figure 2:
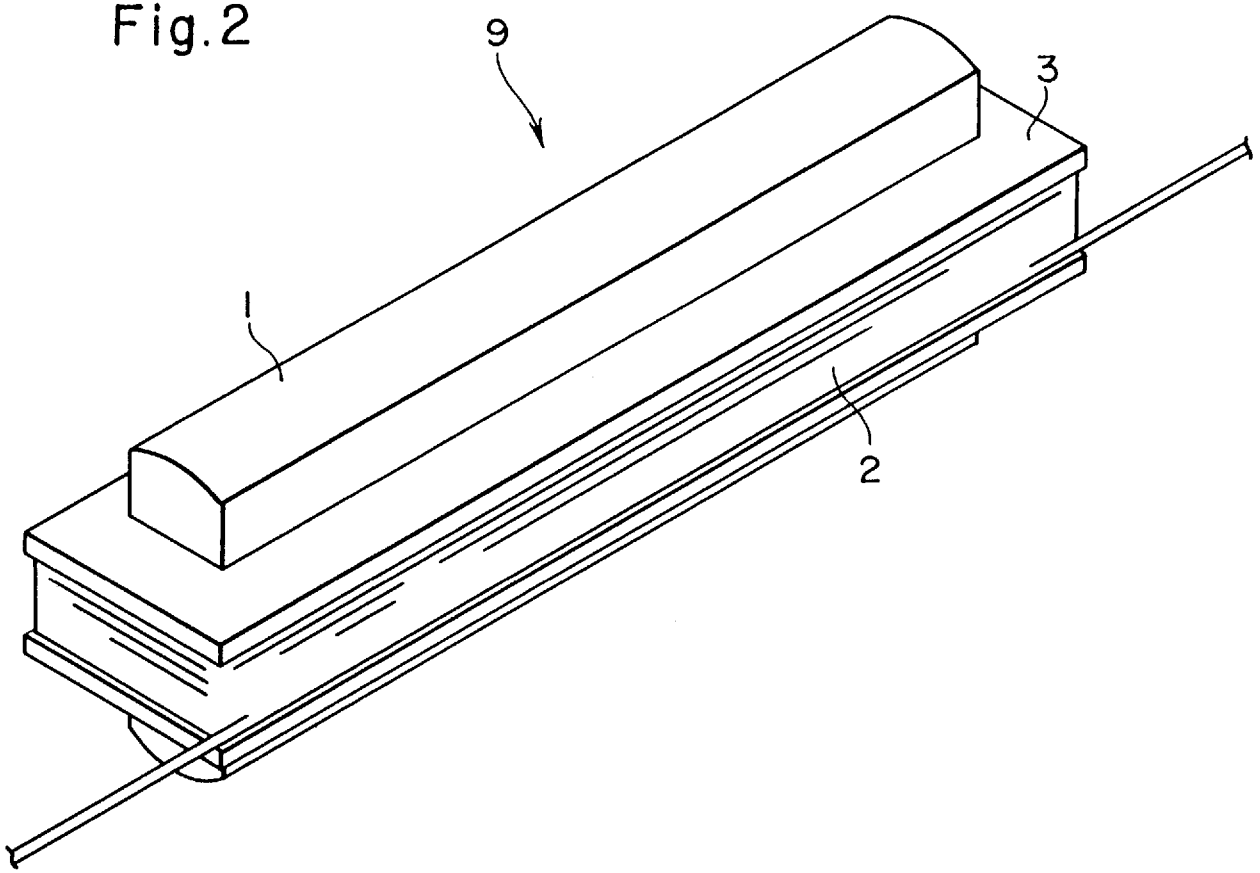
FIG. 2 is a perspective view to aid in the description of a coil assembly in the induction heating type fixing apparatus.
Figure 3:
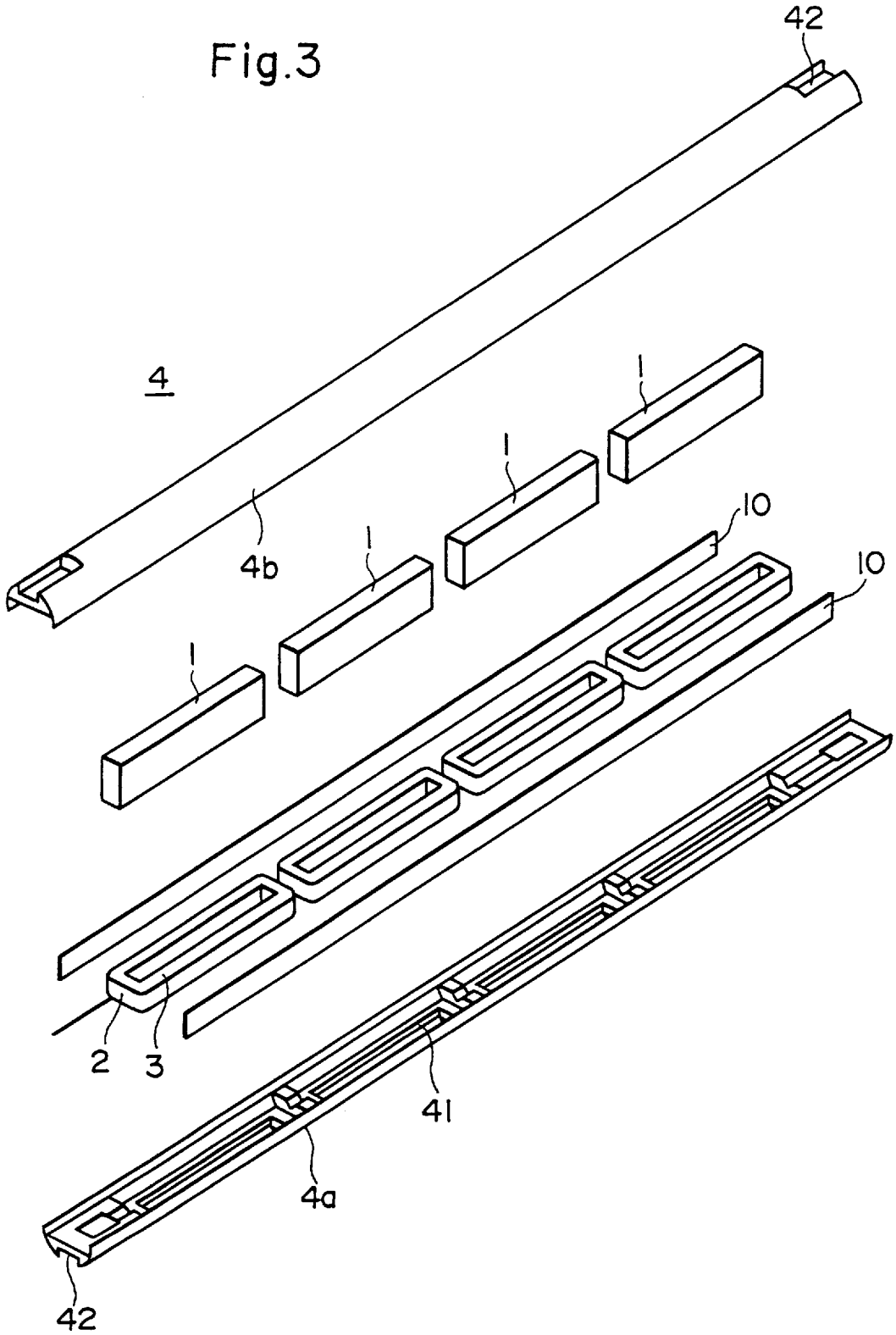
FIG. 3 is an exploded perspective view to aid in the description of a holder unit in the induction heating type fixing apparatus.

FIG. 1 is a structural diagram illustrating an induction heating type fixing apparatus as the first embodiment of this invention, FIG. 2 a perspective view to aid in the description of a coil assembly in the induction heating type fixing apparatus, and FIG. 3 an exploded perspective view to aid in the description of a holder unit of the induction heating type fixing apparatus.

As illustrated in FIG. 1, the induction heating type fixing apparatus which is incorporated in a printer, for example, is provided with a thin fixing sleeve 5 with flexibility comprising, at least, one layer (hereinafter referred to as "metal layer") formed of a metallic material, a coil assembly 9 for generating a high-frequency magnetic field and induction heating the fixing sleeve 5, a holder 4 for retaining the coil assembly 9, and a pressing roller 6 adapted to be pressed against the holder 4 through the fixing sleeve 5. The coil assembly 9 is provided with a core 1 and a coil 2. The holder 4 has a cross section of such an endless shape as that of a cylinder. The coil assembly 9 is stowed and retained inside the holder 4 to form a holder unit integrally. The fixing sleeve 5 encompasses the periphery of the holder 4 and emits heat based on an induced eddy current generated by a magnetic field from the coil 2. The pressing roller 6 is disposed rotatably in the direction of the arrow a in FIG. 1. When the pressing roller 6 rotates while pressing the holder 4 through the fixing sleeve 5, a sheet 8 as a recording medium is conveyed as nipped in the nipping part, i.e. the part of sliding contact between the pressing roller 6 and the fixing sleeve 5. Thus, the toner on the sheet 8 is melted and fixed thereon.

The fixing sleeve 5 comprises a base layer and a surface layer touching to the sheet 8 and at least, one of the layers or the surface layer is made of metal. And the fixing sleeve 5 is, as a whole, in the shape of a thin hollow metallic conductor with flexibility. In addition to the layer made of metal, a layer made of resin may be used as the base layer of the fixing sleeve 5. For example, it is conceivable to construct the fixing sleeve by using a heat-resistant film of a resinous material as the base layer and forming on the outside of this base layer a surface layer as an electrically conductive layer by a plating treatment and the like. In this case, since the surface of the resinous material has high coefficient of heat emission as mentioned above, the resin on accumulating heat radiates heat in a large amount and consequently entails waste of electric power. Therefore, the layer made of metal is preferable to the layer made of resin because the fixing sleeve using the layer made of metal radiates heat in a small amount and cannot waste electric power as compared with the fixing sleeve using the layer made of resin.

For that reason, not only the surface layer but the base layer of the fixing sleeve according to the embodiments is made of metal. Besides, the surface layer and the base layer are made of a metallic material as one instead of the individual formation of the surface layer and the base layer. Accordingly, in the embodiments, "metal layer of the sleeve 5" is defined as a combination of the surface layer and the base layer as one. And in case of using the base layer made of resin, "metal layer of the sleeve 5" merely corresponds to the surface layer.

The metal layer of the fixing sleeve 5 is preferably formed of such an electrically conductive ferromagnetic material as iron, nickel, or SUS430. When the fixing sleeve 5 is formed with the ferromagnetic material, the efficiency of heat generation is further improved because many magnetic fluxes pass the interior of the fixing sleeve 5. The fixing sleeve 5 has the peripheral surface thereof coated with fluorocarbon resin as a heat-resistant release layer capable of facilitating the separation of the sheet 8. The metal layer of the fixing sleeve 5, namely the surface layer touches to the sheet 8 through the release layer.

Figure 7:
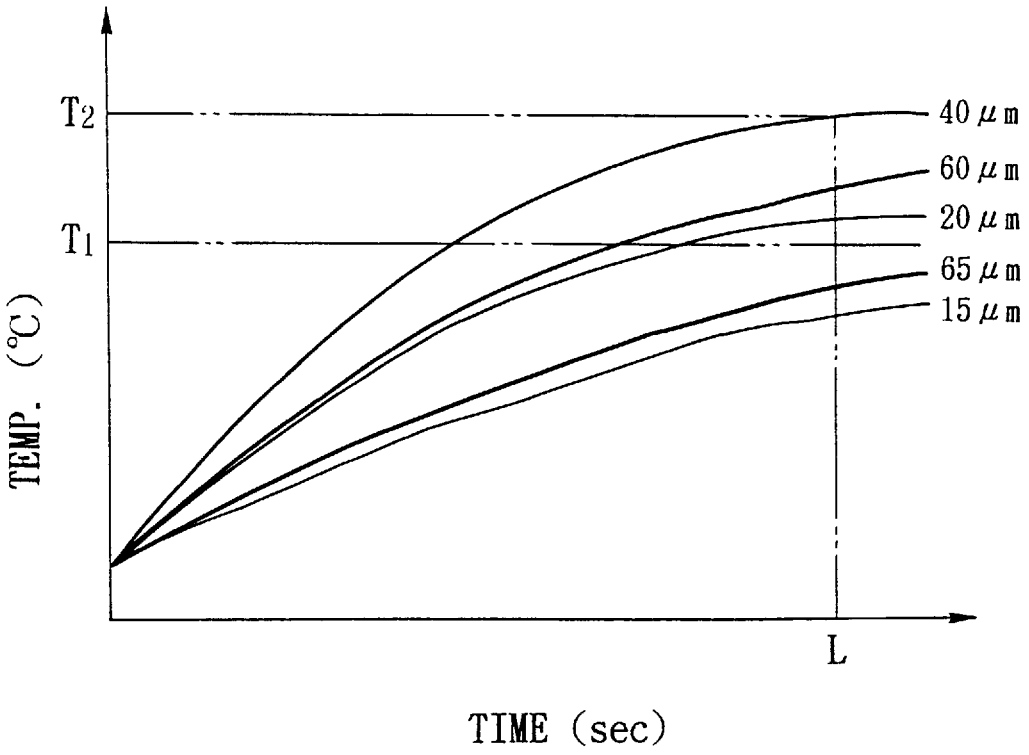
FIG. 7 is a graph showing the influence of the section thickness of the metal layer of the fixing sleeve on the property of temperature rise.

Now, the section thickness of the fixing sleeve 5 will be described below. The heat capacity of the fixing sleeve 5 decreases and the electric power required for causing the fixing sleeve 5 to generate heat likewise decreases in proportion as the thickness of the fixing sleeve decreases. If the thickness of the fixing sleeve is decreased to an excess, the fixing sleeve becomes problematic in terms of durability because it is degraded in strength and disposed to sustain breakage. In the manufacture of the fixing sleeve, the uniformization of its thickness is not easy to attain and is liable to boost the cost of production. Conversely, if the thickness of the fixing sleeve is increased to an excess, the fixing sleeve will yield to the bending force and lose flexibility. Thus, it will become difficult to make a partial change in the radius of curvature of the fixing sleeve for the purpose of forming the nipping part of a large area. The increase of this thickness results in increasing amount of the material required for the production and consequently boosting the cost of material. FIG. 7 is a graph showing the influence of the section thickness of the metal layer of the fixing sleeve on the property of temperature rise, the horizontal axis representing the scale of the elapse of time from the start of power supply of the fixing apparatus and the vertical axis the scale of the temperature of the fixing sleeve. Five samples of the fixing sleeve, 15 μm, 20 μm, 40 μm, 60 μm, and 65 μm, in section thickness of the metal layer, were tested for the property of temperature rise. In general, the time referred to as "quick fixture" is preferably within 10 seconds of starting the power supply of the apparatus. The fixing apparatus is required to raise the temperature of the fixing sleeve to a range (T1–T2, for example, 150° C.~200° C.) within this duration of 10 seconds. The expression "L" seconds found in FIG. 7 represents the allowable time limit for the "quick fixture." It is clearly noted from this graph that when the section thickness of the metal layer of the fixing sleeve is 15 μm, i.e. smaller than 20 μm, the temperature of the fixing sleeve does not reach the level allowing the fixture even after the elapse of the allowable time limit. The reason for the elongation of the warm-up period is that the ability of the metal layer to absorb electric power is degraded and the efficiency of thermo-electric conversion is degraded when the metal layer is unduly thin. When the section thickness of the metal layer of the fixing sleeve exceeds 65 μm, namely more than 60 μm, the temperature of the fixing sleeve cannot be raised to the level allowing the fixture within the allowable time limit because the heat capacity of the entire fixing sleeve is proportionately increased. When these test results and the problems on the manufacture are considered, it is found proper to give the metal layer of the fixing sleeve a section thickness in the approximate range of 20 μm~60 μm. When the section thickness of the metal layer of the fixing sleeve is set within the range of 20 μm~60 μm, the production of a fixing apparatus which excels in durability, property of temperature rise, and cost can be realized.

The fixing sleeve 5 is not fixed to any of the component members of the apparatus and is allowed to rotate freely round the holder 4. In contrast, the holder 4 is fixed to the apparatus proper. Of the peripheral surface of the holder 4, at least the part that contacts the fixing sleeve 5 is formed flatly and smoothly with a heat-resistant resinous material. Since the friction resistance between the holder 4 and the fixing sleeve 5 is smaller than that between the sheet 8 and the fixing sleeve 5, the fixing sleeve 5 follows the motion imparted to the sheet 8 by the rotation of the pressing roller 6. The holder 4 is provided at the opposite ends thereof with flanges (not shown) adapted to prevent the fixing sleeve 5 from deviating in the longitudinal direction of the holder 4.

The coil assembly 9, as illustrated in FIG. 2 and FIG. 3, is further provided with a bobbin 3 having a through hole formed in the central part thereof. The coil 2 is formed by winding a copper wire several times round the bobbin 3. The core 1 is inserted into the through hole of the bobbin 3 perpendicularly to the copper wire of the coil 2. This coil assembly 9 is retained inside the holder 4 which will be specifically described herein below so that the core 1 will parallel the direction of conveyance of the sheet. The core 1 is in the form of a ferrite core or a laminated core, for example. Since the core 1 has a simple shape of the letter I, the cost of production thereof is low and the work of inserting the core 1 into the through hole of the bobbin 3 is simple. When the coil assembly 9 is retained inside the holder 4, the end face of the core 1 in the longitudinal direction of its cross section approximates closely to the inner wall of the holder 4. When the core 1 is disposed as described above, the air gap between the core 1 and the fixing sleeve 5 is narrowed. The magnetic reluctance of the air gap is much larger than the magnetic reluctance of the core 1 and the fixing sleeve 5. Accordingly, the magnetic attachment of the core 1 with the fixing sleeve 5 is strengthened and the transmission of electric power is attained at a high efficiency by narrowing the air gap. The end face of the core 1 may be formed in an arcuate shape, for example, so as to conform to the inner surface of the holder 4. Since the bobbin 3 is heated with the heat conducted from the circumference thereof, the bobbin 3 requires heat-resisting properties enough to withstand at least the fixing temperature, i.e. the surface temperature of the fixing sleeve. Thus, the bobbin 3 is formed with a ceramic material or a heat-resistant engineering plastic material with insulating properties. As concrete examples of the engineering plastic material, PPS (polyphenylene sulfide), PEEK (polyetherether ketone), LCP (liquid crystal polymer), and phenol resin may be cited. As the copper wire for forming the coil 2, it is advantageous to use a single copper wire or a lits copper wire which is provided on the surface thereof with a fusion layer and an electrical insulating layer. The provision of the coil assembly 9 with the bobbin 3 for winding the coil 2 thereon not only facilitates the operation of coiling but also enables the winding to be stably carried out. Since the bobbin 3 ensures the electric insulation between the core 1 and the coil 2, this fixing apparatus gets the trouble of fewer occurrence and, therefore, enjoys high reliability of its operation.

The holder 4 accommodating the coil assembly 9 therein, as illustrated in FIG. 3, is provided with a holder stay 4*a* and a holder cover 4*b* attached to the holder stay 4*a*. The holder stay 4*a* and the holder cover 4*b* are severally formed of an engineering plastic material possessed of the heat-resistant properties and the insulating properties. A depressed part 41 for retaining the coil assembly 9 is formed concurrently in the inner surfaces of the holder stay 4*a* and the holder cover 4*b*. The holder stay 4*a* and the holder cover 4*b* are provided severally at the opposite ends thereof with setting parts 42 adapted for fixing the holder 4 to the fixing unit frame of the apparatus proper. The holder 4 is assembled by inserting the bobbins 3 each having the coil 2 formed thereon in the depressed part 41 of the holder stay 4*a*, inserting the cores 1 in the through holes of the bobbins 3, disposing insulating films 10 on the outer surfaces of the coils 2, and setting the holder cover 4*b* on the holder stay 4*a*. The plurality of coils 2 are connected in series inside the holder 4. The holder 4 is provided at the opposite ends thereof (or either of the ends) with connector terminals (not shown) which allow the terminals of the coils 2 to be connected thereto. The coils 2 are connected through these terminals to a high-frequency power source which will be specifically described hereinbelow.

In general, the holder changes the shape to have a bending (deformation) when the pressing roller exerts contact pressure on the holder. The holder lies being heated by heat transmission from the neighborhood. For that reason, when the holder is made of a resinous material, the degree of deformation is relatively large in particular. The large deformation of the holder by the pressure produces the uneven pressure distribution in the nipping part in the longitudinal direction thereof. As a result, evenness of the fixing property may not be obtained and conveyance of the sheet is badly effected. As obviously shown in FIG. 1, the holder 4 is so formed that the holder 4 may possess an endless circumference in reference to a plane perpendicular to an axis of the holder 4, or have a cross section of an endless shape on condition that the holder 4 is equipped with the holder stay 4*a* and the holder cover 4*b*. Consequently, the stiffness of the holder 4 which can confront the contact pressure exerted by the pressing roller is ensured. It results in equalizing the fixing property along the longitudinal direction of the holder and bringing no failure of conveyance. In addition, electrical insulation between the coil 2 and the fixing sleeve 4 is surely attained without a break and it prevents an electric current passing through the coil 2 from short-circuiting between the coil 2 and the fixing sleeve 5.

The pressing roller 6, as illustrated in FIG. 1, is composed of an axial core 61 and a silicone rubber layer 62 formed on the outer surface of the axial core 61. The silicone rubber layer 62 is formed of a rubber material which is possessed of the release properties ensuring easy separation of the sheet 8 from the surface of the layer and the heat-resistant properties. The pressing roller 6 is provided at the opposite ends thereof with sliding bearing (not shown) so as to be freely rotatably attached to fixing unit frame 63 of the apparatus proper. The pressing roller 6 is pressed by a spring member 64 disposed on the fixing unit frame 63 toward the holder 4 across the fixing sleeve 5. The pressing roller 6 is further provided at one end thereof with a drive gear (not shown), which is connected to such a drive source as a motor and adapted to transmit a rotation to the pressure roller 6.

A temperature sensor for detecting the temperature of the fixing sleeve 5 is pressed against the surface of the fixing sleeve 5. This temperature sensor is formed of a thermistor 7, for example. The power supply for the coil 2 is controlled as will be specifically described hereinbelow so as to optimize the temperature of the fixing sleeve 5, with the thermistor 7 continuing the detection of the temperature of the fixing sleeve 5.

A thermostat 23 as a safety mechanism against abnormal rise of temperature is provided on the fixing sleeve 5. This thermostat 23 keeps contact with the surface of the fixing sleeve 5 and, when the preset temperature is reached, breaks this contact and terminates the supply of electric power to the coil 2. This operation of the thermostat 23 prevents the temperature of the fixing sleeve 5 from rising above the prescribed level.

Figure 4:
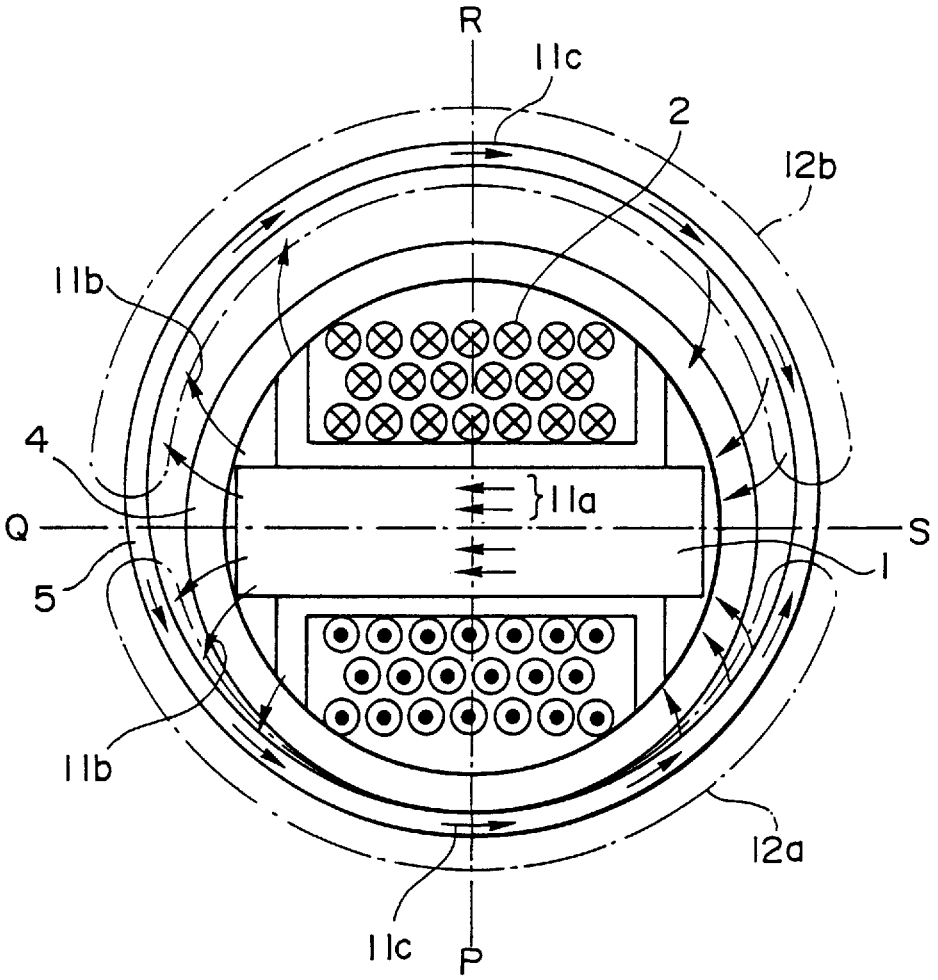
FIG. 4 is an explanatory diagram illustrating the principle of heating of a fixing sleeve in the induction heating type fixing apparatus.

FIG. 4 is an explanatory diagram to aid in the description of the principle of heating adopted for the fixing sleeve in the induction heating type fixing apparatus in the present embodiment. When the current of a high frequency (several kHz~some tens of kHz) flows through the coil 2, magnetic fluxes 11*a* perpendicular to the direction of the longitudinal axis of the fixing sleeve are generated from the core 1 as illustrated in accordance with the "Ampere's right-handed screw rule". These magnetic fluxes 11*a* are also high-frequency magnetic fluxes.

The magnetic fluxes 11*b*, on arriving at the fixing sleeve 5 of the electric conductor, are bent along the fixing sleeve 5 and converted into magnetic fluxes 11*c* which travel inside the inner wall surface of the fixing sleeve 5 at a ratio relying on the relative permeability of the electric conductor. The magnetic fluxes 11*c* concentrating on the peripheral surface of the fixing sleeve 5 assume the maximum density in the part opposite the coil 2.

The action of the concentrated magnetic fluxes 11*c*, in accordance with the "Lenz's law," causes the fixing sleeve 5 to produce therein a vortex shaped induced current which tends to generate magnetic fluxes countering the magnetic fluxes 11*c* in the direction opposite the magnetic fluxes 11*c*. This induced eddy current is converted into Joule heat by the skin resistance of the fixing sleeve 5. Thus, the fixing sleeve 5 generates heat.

In this structure, the magnetic flux density within the inner wall surface of the fixing sleeve 5 is maximized at the points P and R and conversely minimized at the points Q and S. Since the induced current density consequently assumes the same trend, the heat generation by the fixed sleeve 5 is not uniform throughout within the inner wall surface. The points P and R constitute the points of maximum heat generation and the portions 12*a* and 12*b* enclosed with a line of alternate two dots and one dash are the sites for local generation of heat. The parts 12*a* and 12*b* which locally generate heat correspond to the upper area and the lower area of the fixing sleeve 5 as illustrated in FIG. 1. The nipping part and one of the portions (areas) of heat generation, therefore, overlap each other at least partly. The thermistor 7 is disposed to contact the one portion of heat generation and the thermostat 23 to contact the other portion of heat generation. In the illustrated embodiment, since the core 1 enclosed by the coil 2 is disposed parallel to the direction of conveyance of the sheet, the nipping part and one of the areas of heat generation of the fixing sleeve 5 are overlapped as mentioned above. As a result, the heat of the fixing sleeve 5 may be sufficiently transferred to the toner without a heat loss. The thermistor 7 may be attached to either the upper part or the lower part of the fixing sleeve 5, whichever better suits the occasion. In the illustrated embodiment, it is attached to the outside of the lower part. When the thermistor 7 is small, it may be attached either to the inside of the upper part or to the inside of the lower part of the fixing sleeve 5.

The fixing sleeve 5, as illustrated in FIG. 4, is possessed of the two points, P and R, of maximum heat generation along the circumferential direction. When this phenomenon is observed from the coil side, the coil 2 causes the fixing sleeve 5 to produce an induced eddy current so that the fixing sleeve 5 may be possessed of the two points, P and R, of maximum heat generation. For that reason, the coil assembly 9 is so constructed that the core 1 is in the shape of the letter I to generate magnetic flux on the side (point R) opposite to the nipping part (point P) and, moreover, the air gap between the point R and the coil 2 is narrow to generate enough magnetic flux. In consequence, the magnetic relationship between the coil 2 and the fixing sleeve 5 will be appropriately enhanced and the efficiency of power transmission to the fixing sleeve will be exalted, based on narrowing the air gap. Further, the space for winding the coil 2 can be secured in a generous size within the limited inner volume of the holder 4 and the loss in the coil 2 can be decreased by using thick copper wire for decreasing copper loss. As a result, the coil assembly 9 as a whole and the holder 4 can be reduced appreciably in size enough to realize a compact fixing apparatus. Conversely, if the coil assembly is so constructed that the core is in the shape of the letter E and a portion of the fixing sleeve generates heat, the coil, dimensions of the core, etc., require to be small. In this case, it is necessary to pass high current through fine copper wire and, thus, the coil will incur an unduly large loss and the efficiency of power transmission to the fixing sleeve will be unduly low. In addition, large electric power corresponding to the circumferential length of the sleeve or inside dimensions of a body of rotation, can not be generated.

Figure 5:
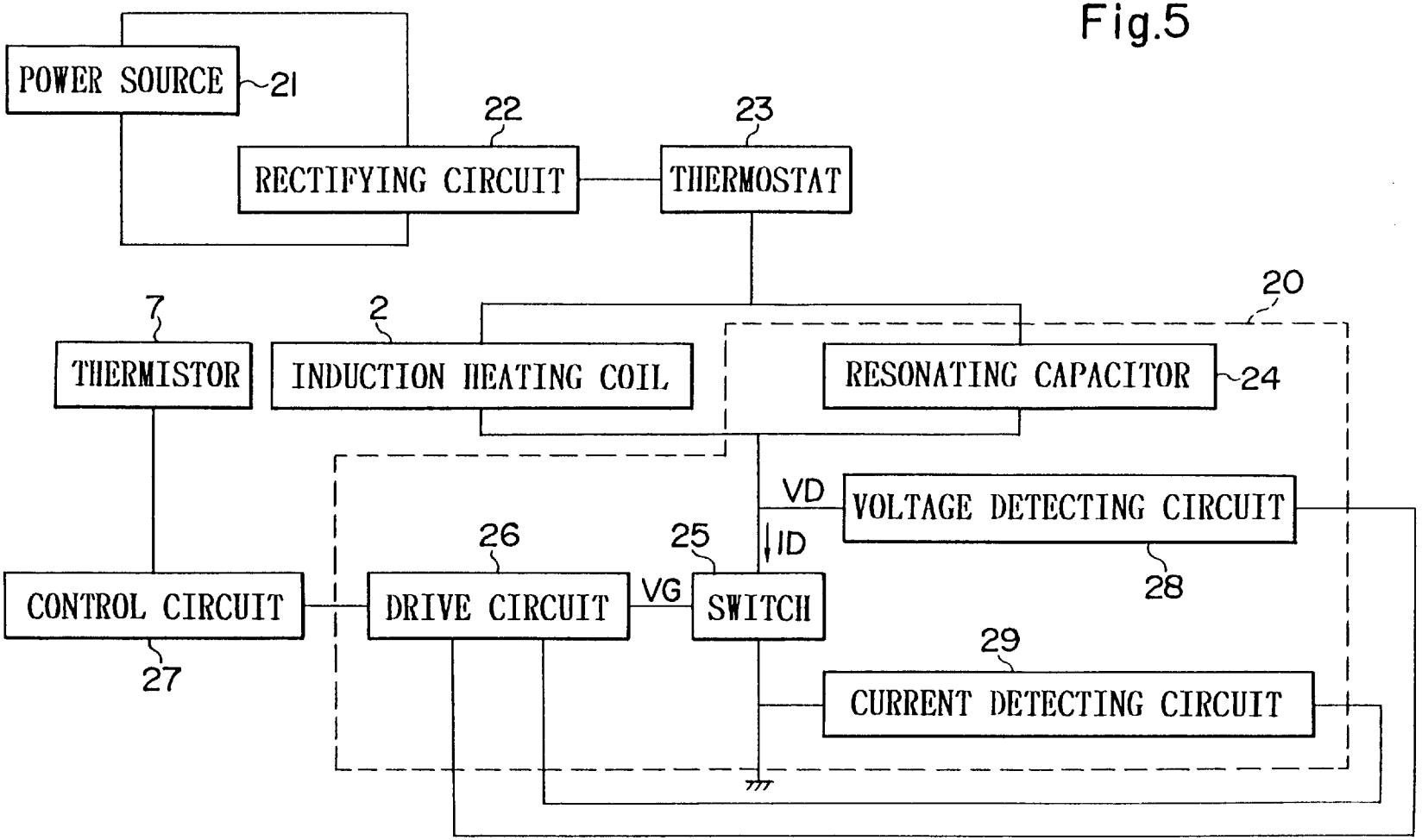
FIG. 5 is a block diagram illustrating a control system in the induction heating type fixing apparatus.

Now, the control system for this fixing apparatus will be described below. FIG. 5 is a block diagram of this control system.

The high-frequency current is derived by rectifying the alternating current from a commercial power source 21 by a rectifying circuit 22 and converting the rectified alternating current into a high-frequency wave in a self-inverter circuit 20. The current to the induction heating coil 2 is supplied through the thermostat 23 which is kept in pressed contact with the surface of the fixing sleeve 5. The thermostat 23 breaks the current circuit when it detects the fact that the surface temperature of the fixing sleeve 5 has reached a preset abnormal level. A control circuit 27 is composed of a microprocessor, a memory, etc. and adapted to effect temperature control by monitoring the temperature of the fixing sleeve 5 on the basis of the potential of the thermistor 7 and meanwhile outputting an ON/OFF signal to a drive circuit 26 within the inverter circuit 20. The inverter circuit 20 converts the direct current from the rectifying circuit 22 into a high-frequency current and supplies the high-frequency current to the coil 2.

Figures 6A, 6B, 6C:
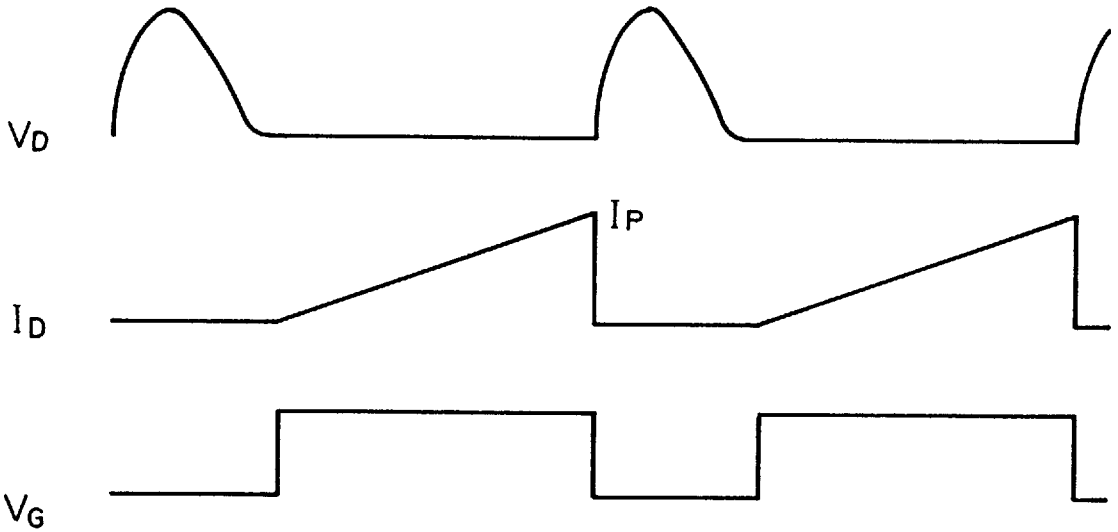
FIG. 6A is a diagram illustrating the waveform of voltage to be detected in a voltage detecting circuit shown in FIG. 5.
FIG. 6B is a diagram illustrating the waveform of current to be detected by a current detecting circuit shown in FIG. 5.
FIG. 6C is a diagram illustrating the waveform of an ON/OFF signal of a switching element shown in FIG. 5.

In the inverter circuit 20, when the control signal (heat signal) outputted from the control circuit 27 is switched to the ON state, first the drive circuit 26 turns on a switching element 25 which is formed of transistors, FET's, or IGBT's, for example. Thus, the electric current flows through the induction heating coil 2. Meanwhile, a current detecting circuit 29, on detecting the fact that the magnitude of the current has reached a prescribed level $I_P$ outputs to the drive circuit 26 a signal to turn off the switching element 25. The waveform of the drain current $I_D$ to be detected in the current detecting circuit 29 is illustrated in FIG. 6B. When the switching element is turned off, a resonance current starts flowing between the induction heating coil 2 and a resonating capacitor 24. Then, a voltage detecting circuit 28, on detecting the fact that the drain voltage $V_D$ on the induction heading coil 2 side of the switching element 25 has been lowered by the resonance to the neighborhood of zero V, outputs to the drive circuit 26 a signal to turn on the switching element 25. The flow of the high-frequency current to the induction heating coil 2 is then continued by repeating the switching cycle described above. The waveform of the voltage $V_D$ to be detected by the voltage detecting circuit 28 is illustrated in FIG. 6A and the ON/OFF signal $V_G$ of the switching element 25 (the ON/OFF signal of the gate in case of the FET) is illustrated in FIG. 6C.

The induction heating type fixing apparatus thus constructed operates as follows.

The sheet 8 carrying the unfixed toner image is conveyed from the left as indicated by an arrow b in FIG. 1 and forwarded toward the nipping part between the fixing sleeve 5 and the pressing roller 6. The sheet 8 is conveyed through the nipping part as held in intimate contact with the fixing sleeve under the pressure exerted by the pressing roller 6. Thus, the heat of the fixing sleeve 5 controlled as described above and the said pressure cooperate to fix the unfixed toner on the sheet 8 and produce a fixed toner image on the sheet 8. The toner is deposited on one of the opposite surfaces of the sheet 8 which contacts the fixing sleeve 5. The sheet 8 which has passed through the nipping part is spontaneously separated from the fixing sleeve 5 because of the flexibility of the fixing sleeve 5 and then conveyed to the right in FIG. 1. This sheet 8 is further conveyed by a paper discharging roller (not shown) and released into a paper discharge tray.

Second Embodiment

Figure 8:
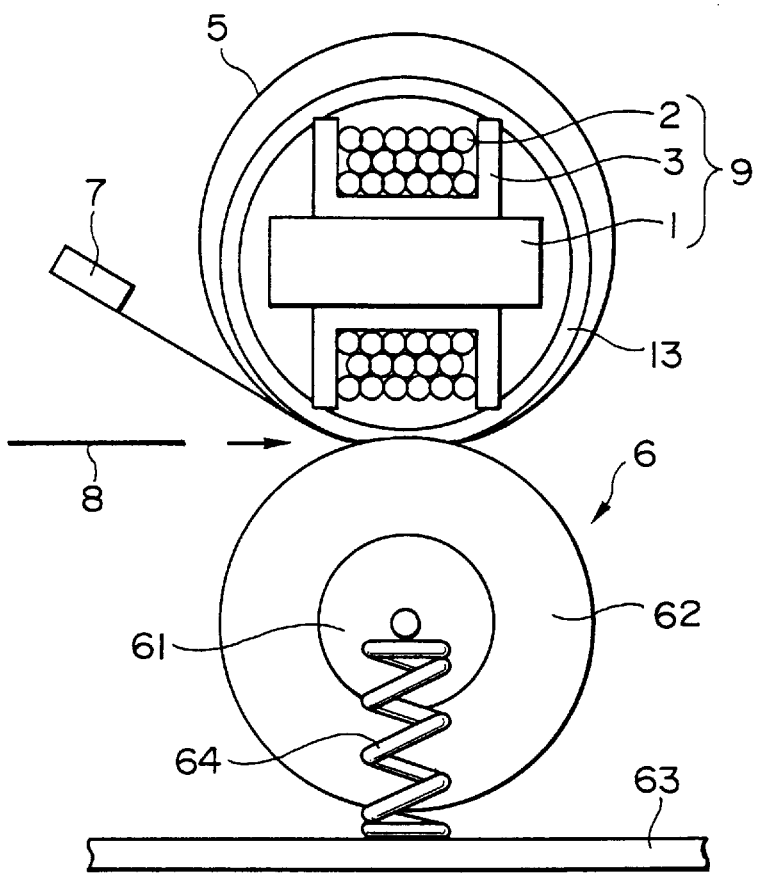
FIG. 8 is a structural diagram illustrating an induction heating type fixing apparatus as the second embodiment having a nipping part changed in shape.

Now, another embodiment of the present invention will be described below. FIG. 8 is a structural diagram illustrating an induction heating type fixing apparatus as a second embodiment. The second embodiment differs from the first embodiment in respect that the nipping part is changed in shape.

In this induction heating type fixing apparatus, the coil assembly 9 which comprises the core 1 and the coil 2 wound round the core 1 is stowed in a holder 13. The flexible fixing sleeve 5 made of a metallic material and adapted to generate heat by an induced current encompasses this holder 13. The pressing roller 6 exerts pressure on the holder 13 through the fixing sleeve 5. The surface of contact of the holder 13 confronting the pressing roller 6 is formed in a depressed shape conforming to the shape of the pressing roller 6 so as to allow an elongation for the distance over which the sheet passes through the nipping part.

The induction heating effects simultaneous heating of a fairly wide area of the fixing sleeve 5. The second embodiment harnesses this phenomenon for enlarging the nipping part and consequently providing the toner with heat amply. Thus, the temperature of the fixing sleeve 5 is allowed to be set at a rather lower level.

Since the other structure and operation of the present embodiment are identical to those of the first embodiment, they will be omitted from the following description.

Third Embodiment

Figure 9:
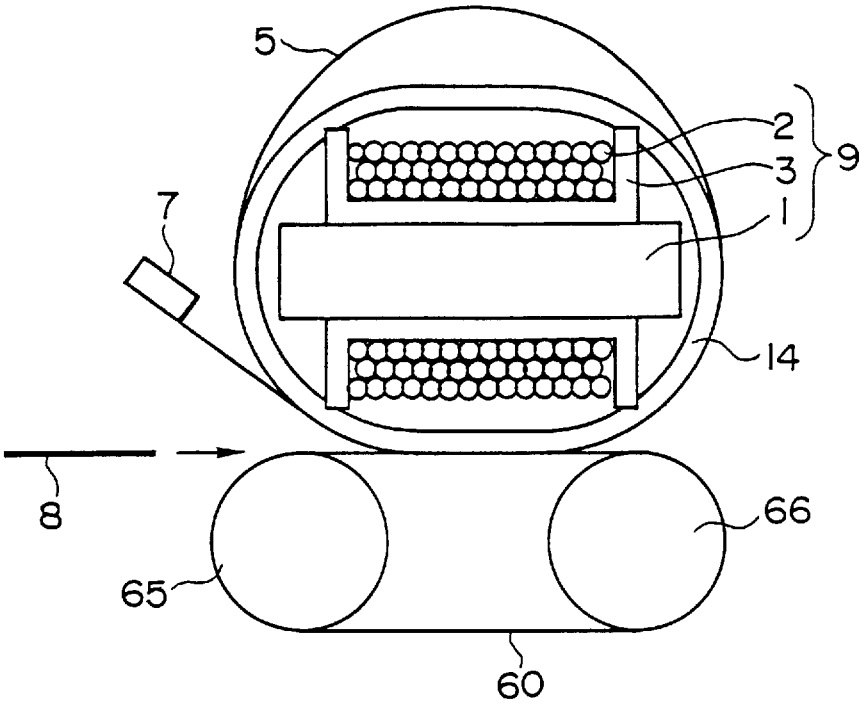
FIG. 9 is a structural diagram illustrating an induction heating type fixing apparatus as the third embodiment having a nipping part further changed in shape.

FIG. 9 is a structural diagram illustrating an induction heating type fixing apparatus according to the third embodiment. The third embodiment has the nipping part in a further changed shape and uses a belt in the place of the pressing roller.

In this induction heating type fixing apparatus, the coil assembly 9 which comprises the core 1 and the coil 2 wound on the core 1 is stowed in a holder 14 and the flexible fixing sleeve 5 made of a metallic material and adapted to generate heat by means of an induced current encompasses this holder 14. A belt 60 passed round pulleys 65 and 66 exerts pressure through the fixing sleeve 5 on the holder 14 which has a flat and smooth surface for the intended contact.

Thus, the nipping part is allowed to be wider and the temperature of the fixing sleeve 5 to be lower than in the second embodiment.

Since the other structure and operation of the present embodiment are identical to those of the first embodiment, they will be omitted from the following description.

Fourth embodiment

Figure 10:
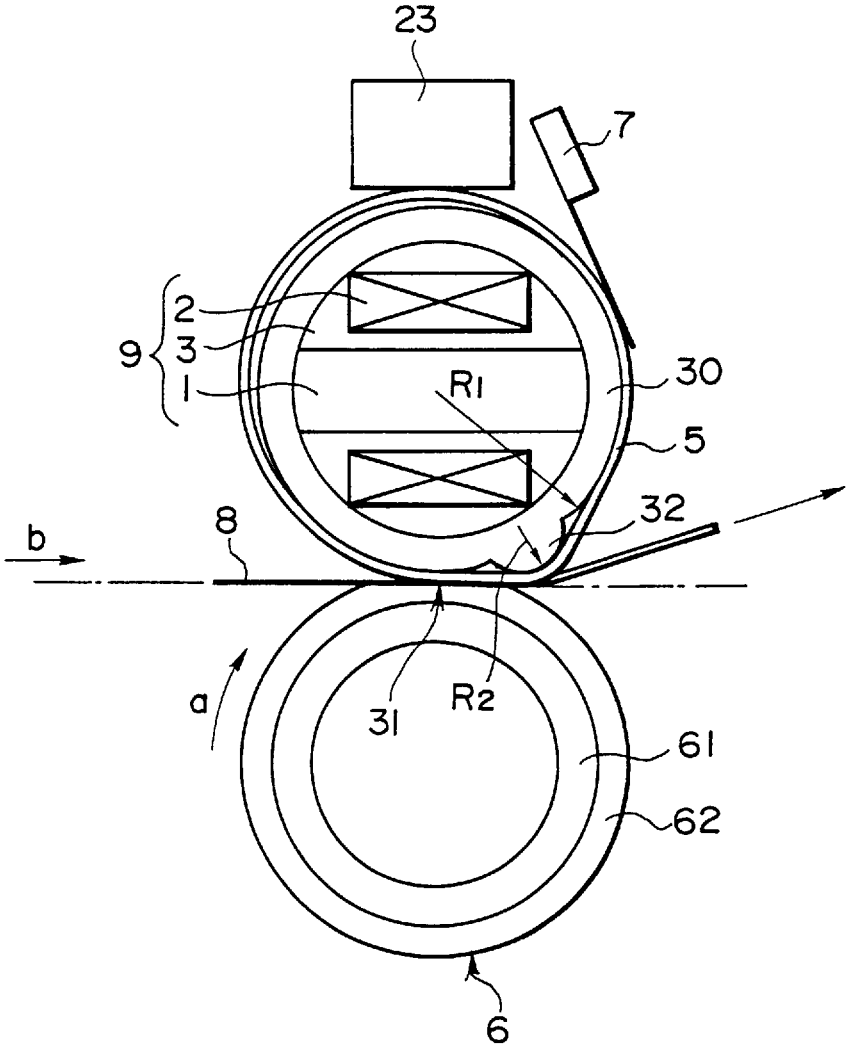
FIG. 10 is a structural diagram illustrating a fixing apparatus of inducting heating as the fourth embodiment provided with a separating member.

FIG. 10 is a structural diagram illustrating an induction heating type fixing apparatus as the fourth embodiment of this invention. The fixing apparatus of the fourth embodiment contemplates infallibly separating the sheet 8 discharged from the nipping part without requiring the use of a separation claw. In FIG. 10, like components found in the first embodiment are denoted by like reference numerals. These components will be omitted from the following description.

This fixing apparatus, as illustrated in FIG. 10, causes a heating element to generate heat based on the principle of induction heating. It is possessed of the coil assembly 9 for producing a high-frequency magnetic field, the fixing sleeve 5 disposed freely movably along the direction of conveyance of the recording medium 8 heated by the coil assembly 9, a stationary holder 30 adapted to accept the fixing sleeve 5 into sliding contact therewith, and the pressing roller 6 opposed to and pressed against the holder 30 and the fixing sleeve 5 through the path of conveyance of the recording medium 8. The pressing roller 6 is disposed rotatably in the direction of the arrow a in FIG. 10 and the fixing sleeve 5 is nipped between the pressing roller 6 and the holder 30 and rotated by following the rotation of the pressing roller 6.

The recording medium or the sheet 8 carrying the unfixed toner image thereon is conveyed from the left as indicated by the arrow b in FIG. 10 and advanced toward a nipping part 31 which intervenes between the fixing sleeve 5 and the pressing sleeve 5. The sheet 8 is conveyed in the nipping part 31 as exposed to the heat from the heated fixing sleeve 5 and the pressure exerted by the pressing roller 6. Thus, the unfixed toner is fixed on the sheet 8 and a fixed toner image is consequently formed on the sheet 8. The toner is deposited on one of the opposite surfaces of the sheet 8 which contacts the fixing sleeve 5. The sheet 8 which has passed through the nipping part 31 is separated from the fixing sleeve 5 and conveyed to the right in FIG. 10. The sheet 8 is conveyed by a discharge roller (not shown) and released into a paper discharge tray.

In the present embodiment as in the first embodiment, the fixing sleeve 5 is provided therein with the coil assembly 9 which is adapted to generate a high-frequency magnetic field for the purpose of causing the fixing sleeve 5 to produce an induced current (eddy current) and consequently emit Joule heat. This coil assembly 9 is retained inside the holder 30. The holder 30 is fixed to the fixing unit frame (not shown) and not allowed to rotate.

The coil assembly 9 is provided with the core 1 made of a magnetic material, the bobbin 3 having a through hole formed therein for accepting the insertion of the core 1 therein, and the induction coil 2 for enabling the fixing sleeve 5 formed by winding a copper wire round the bobbin 3 to generate an induced current and emit heat. The bobbin 3 functions as an insulating part for isolating the core 1 and the coil from each other. The coil assembly 9 is stowed in the holder 30 formed separately of the bobbin 3 so as not to be exposed to the exterior.

In the illustrated embodiment, the thermistor 7 is disposed above the fixing sleeve 5 and pressed to the surface of the fixing sleeve 5 so as to confront the coil 2 across the fixing sleeve 5.

The fixing apparatus of the fourth embodiment is provided with a separating member 32 of an arcuate cross section having a radius of curvature appropriate for enabling the sheet 8 releases from the nipping part 31 to be infallibly separated by curvature separation from the stationary sleeve 5. The separating member 32 is provided on the holder 30. In the illustrated embodiment, the separating member 32 is formed integrally with the holder 30. The radius $R_2$ of curvature of the separating member 32 in the holder 30 is smaller than the radius $R_1$ of curvature of the part of the holder 30 excluding the separating member 32. Since the holder 30 is installed within the sleeve 5, the separating member 32 is consequently installed within the sleeve 5. Since the separating member 32 presses the fixing sleeve 5 outwardly, namely toward the side intended for contact with the sheet 8, the fixing sleeve 5 is destined to form a separating part which effects the curvature separation of the sheet 8 from the fixing sleeve 5.

Though the size of the separating member 32 in the longitudinal direction is not limited, the separating member 32 is appropriately formed throughout the entire length of the holder 30 in the longitudinal direction in conformity with the maximum width of paper passage. It is allowable to form only one separating member of a relatively small size or to form a plurality of separating members intermittently at proper positions along the longitudinal direction.

Though the radius $R_2$ of curvature of the separating member 32 is more or less variable with such factors as the material and the section thickness of the fixing sleeve 5, the separation member 32 properly has a diameter of not more than about 25 mm in order to attain infallibly the curvature separation of the sheet 8 from the fixing sleeve 5 without requiring the use of a separation claw.

In the illustrated embodiment, the separating member 32 is positioned on the downstream side of the sliding contact part or the nipping part 31 between the pressing roller 6 and the fixing sleeve 5 along the direction of conveyance of the sheet 8. The separating member 32, when necessary, may be disposed at the position of the nipping part 31.

Figure 11:
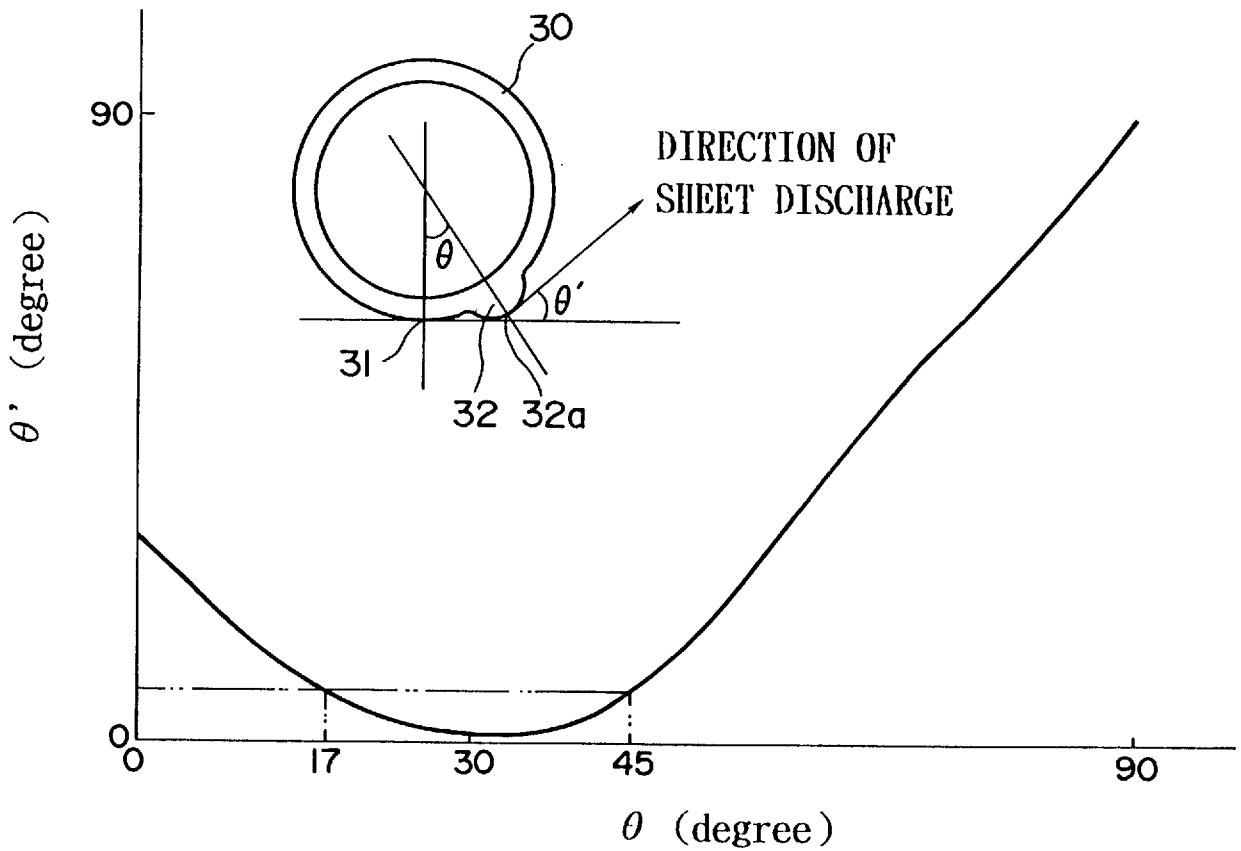
FIG. 11 is a graph showing the relation between the position of the separating member and the angle of inclination of the sheet for curvature separation from the horizontal direction.

FIG. 11 is a graph showing the relation between the position of the separating member 32 and the angle of inclination of the sheet 8 for curvature separation from the horizontal direction. When the separating member 32 is disposed on the downstream side of the nipping part 31, the position thereof on the downstream side is appropriately such that the angle θ formed between the normal at the nipping part 31 and the normal at the point of separation 32*a* on the separation member 32 as shown in FIG. 11 may fall in the range of $17° \leqq \theta \leqq 45°$. So long as the separating member 32 is disposed within this range, the discharging operation produced by the discharging roller can be infallibly performed because the angle θ' of inclination of the sheet 8 in the discharging direction is about 8° upward relative to the horizontal direction of conveyance.

When the separating member 32 is disposed at the position at which the angle θ is about 30 degrees, the angle θ' of inclination of the sheet 8 in the discharging direction is practically zero (horizontal) as clearly noted from FIG. 11. This practical absence of the inclination brings about the advantage that the apparatus has no use any longer for a guide member which serves the purpose of guiding the separated sheet 8 to the discharge roller.

In the fixing apparatus constructed as described above, the fixing sleeve 5 that slides on the holder 30 is deformed along the arcuate separating member 32 provided in the holder 30 and consequently allowed to form a portion having substantially the same radius of curvature as the radius $R_2$ of curvature of the separating member 32. Thus, the sheet 8 released from the nipping part 31 is infallibly destined to contact the fixing sleeve 5 in a state permitting the curvature separation and is separated from the fixing sleeve 5 solely by the curvature separation utilizing the stiffness of the sheet 8. Even when the holder 30 has a large outside diameter as is usually observed in a high-speed apparatus, the curvature attained solely by the stiffness of the sheet 8 so long as the radius of curvature of the separation member 32 is set at an appropriate value.

This fixing apparatus, despite the very simple structure arising from the incorporation of the separating member 32 of an arcuate cross section in the holder 30, infallibly separates the sheet 8 without using a separating claw even when it happens to be applied for a high-speed apparatus. Thus, the sleeve 5 enjoys an elongation of its service life because the possibility that the sleeve will sustain such flaws as scratches on the peripheral surface thereof is completely eliminated. The disruption of a produced image by the flaws, therefore, can be precluded.

Figure 12:
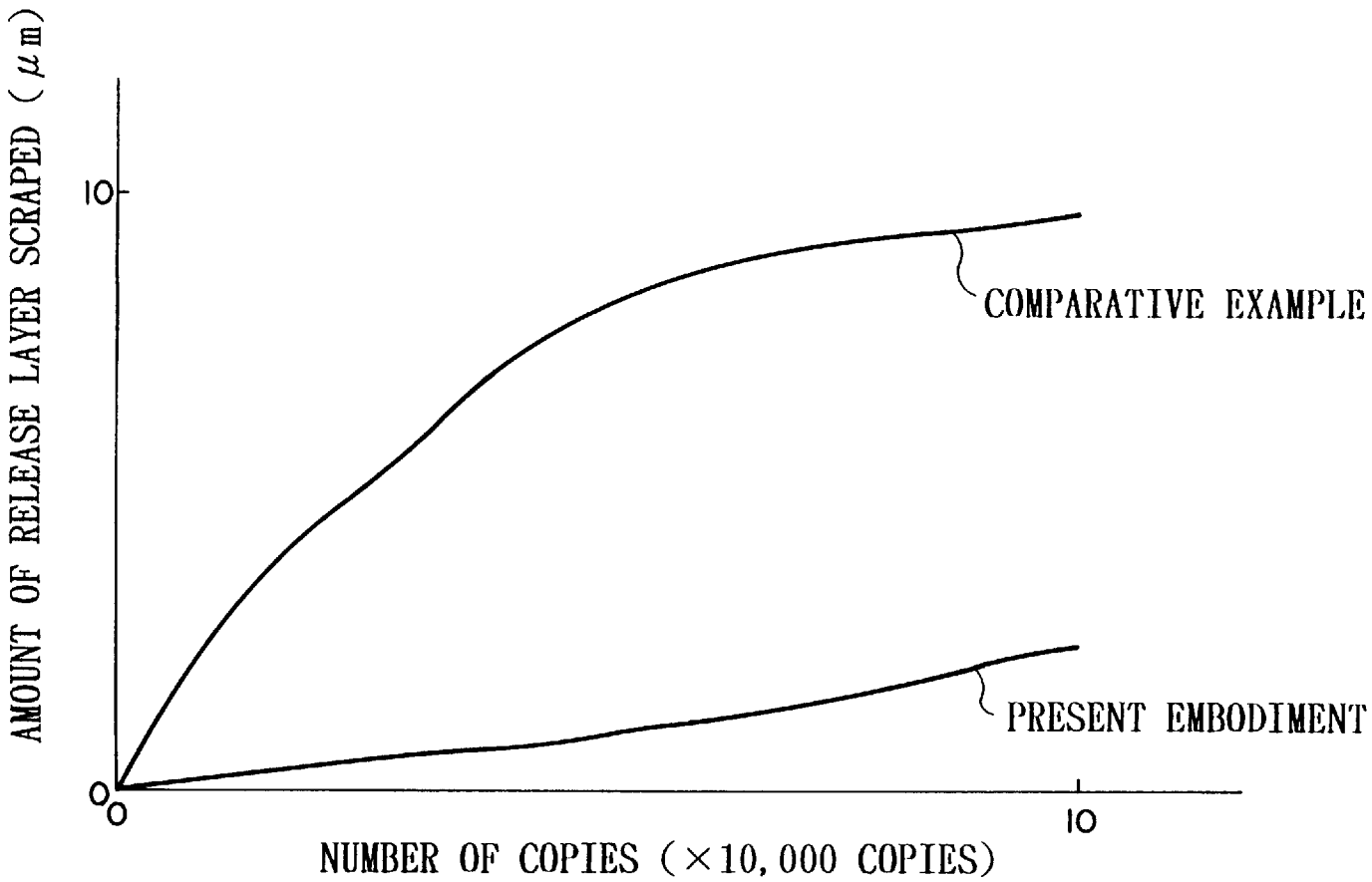
FIG. 12 is a graph showing the relation between the amount of a release layer on the fixing sleeve 5 scraped by use and the number of copies produced.

FIG. 12 is a graph showing the relation between the amount of a release layer on the fixing sleeve 5 scraped by use and the number of copies produced. It is clearly noted from this diagram that the present embodiment which resorts solely to the curvature separation can decrease the amount of the release layer scraped in consequence of the production of 100,000 copies to about ¼ of the amount obtained in the comparative example which resorts to a separation claw and that this decrease proportionately improves the durability of the fixing sleeve 5.

Further, since the present fixing apparatus obviates the necessity for a separation claw and a mechanism for moving this separation claw toward and away from the sheet, the expense otherwise required for these devices can be saved and the fixing apparatus can be simplified in structure possibly to the extent of allowing the fixing apparatus itself and consequently the image forming apparatus to be miniaturized.

Though the illustrated embodiment is depicted as using a cylindrical fixing sleeve 5 as a heating element, this invention is not limited to this structure. The heating element of any material or any shape can be effectively used herein so long as it is deformable in the nipping part 31. The heating element in the shape of a belt, for example, can be used. The coil assembly 9 as a heat source may be disposed outside the holder 30. The heating of the heating element does not need to be limited to the method of induction heating. Various heating methods, for example, the method of heating by the use of a tungsten halogen heater may be adopted instead.

Fifth embodiment

Figure 13:
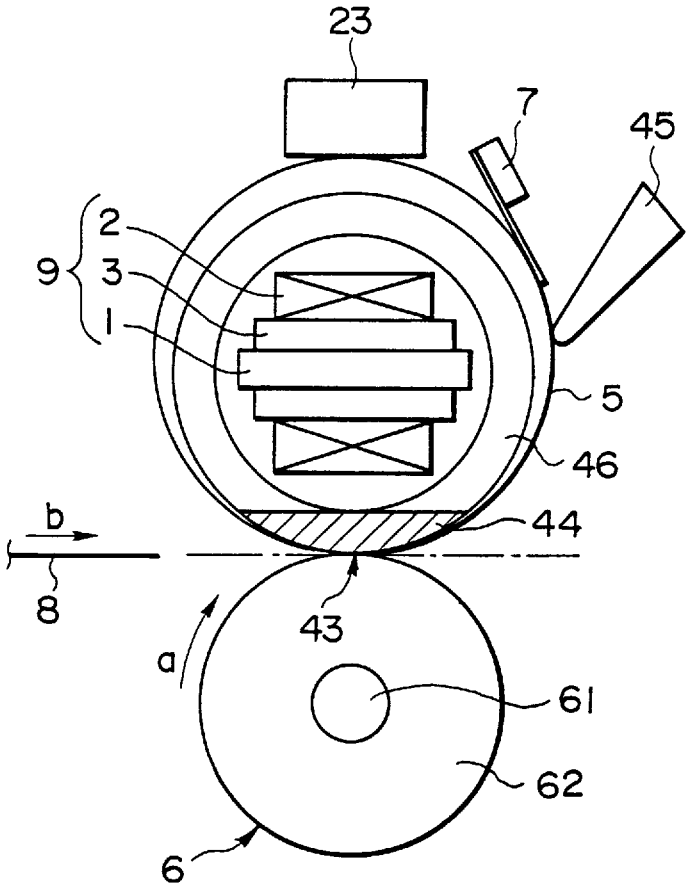
FIG. 13 is a structural diagram illustrating an induction heating type fixing apparatus as the fifth embodiment provided with a heat-diffusing member.

FIG. 13 is a structural diagram illustrating an induction heating type fixing apparatus as the fifth embodiment of this invention. The fixing apparatus of the fifth embodiment is aimed at effectively preventing the uneven temperature distribution in the sleeve 5 in the longitudinal direction thereof, namely in the direction perpendicular to the direction of conveyance of the sheet. In FIG. 13, like components found in FIG. 10 are denoted by like reference numerals. These components will be partially omitted from the following description.

This fixing apparatus, as illustrated in FIG. 13, harnesses the method of induction heating for enabling the heating element to emit heat and, similarly to the fixing apparatus of the fourth embodiment, is possessed of the coil assembly 9, the fixing sleeve 5, a holder 46, and the pressing roller 6. The recording medium or the sheet 8 which has passed through a nipping part 43 between the fixing sleeve 5 and the pressing roller 6 is separated from the fixing sleeve 5 by a separation claw 45 the leading end part of which collides with the surface of the fixing sleeve. The sheet 8 thus separated is then conveyed to the right in FIG. 13. The separation claw 45 is formed of a heat-resistant engineering plastic material with insulating properties.

The fixing apparatus of the fifth embodiment is provided with a heat-diffusing member 44 which is extended in a direction perpendicular to the direction of conveyance of the sheet and made of a material with good thermal conductivity characteristics and non-magnetic properties. The heat-diffusing member 44 is disposed on the holder 46 so as to contact the fixing sleeve 5 as opposed to the position of the nipping part 43 at which the fixing sleeve 5 and the pressing roller 6 contact each other. The heat-diffusing member 44 is laid along the longitudinal direction of the holder 46 (the direction perpendicular to the direction of conveyance of the sheet). Since the holder 46 is installed inside the sleeve 5, the heat-diffusing member 44 is consequently destined to be installed in the sleeve 5.

The heat-diffusing member 44 has an arcuate cross section. The arcuate surface of the heat-diffusing member 44 smoothly continues to the peripheral surface of the holder 46 so as to offer no obstruction to the smooth slide of the fixing sleeve 5. Properly the heat-diffusing member 44 has a shape of a relatively large length equaling the size of the holder 46 in the longitudinal direction. It is allowable alternatively to have a plurality of heat-diffusing members of a relatively small length arranged along the longitudinal direction of the holder 46 on the sole condition that they realize good conduction of heat in the longitudinal direction. In the case of the latter structure, the heat-diffusing members are laid "densely" in the portions close to the opposite ends in the axial direction and "sparsely" at the central portion in the axial direction.

Appropriately, the material possessed of good thermal conductivity characteristics and non-magnetic properties exhibits a relative permeability of about 1 and a coefficient of the thermal conductivity of not less than about 200 W/(m·k) (at 200° C.). Specifically, the heat-diffusing member 44 is formed of aluminum, silver, copper, or an alloy thereof. A ceramic material with an exalted thermal conductivity characteristics may be used instead. Besides, as in the specification and the claims the thermal conductivity is defined as being affected by both coefficient of thermal conductivity and cross-sectional area. The material for the heat-diffusing member 44 is selected and the cross section thereof decided so that the thermal conductivity reaches the prescribed level.

Now, the operation of the fixing apparatus will be described below.

When the high-frequency current is supplied to the induction coil 2, the heat-diffusing member 44 which is formed of a non-magnetic material generates an induced current with difficulty and hardly emits heat, while the fixing sleeve 5 which is formed of a magnetic material generates an induced high-frequency current and emits heat. Since the heat-diffusing member 44 remains in contact with the fixing sleeve 5 which is a heating element, the fixing sleeve 5 is destined to be deprived of its heat by the heat-diffusing member 44. The fixing sleeve 5 elevates its temperature quickly, however, because the method of induction heating enjoys a high efficiency of heat generation and also because the fixing sleeve 5 is formed with a small section thickness. Thus, the advantage of the induction heating type fixing apparatus that resides in curtailing the preheating time and lowering the power consumption is not substantially obstructed.

Further the heat-diffusing member 44 which contacts the fixing sleeve 5 is made of a material with good thermal conductivity characteristics. The fixing sleeve 5, therefore, enjoys an improved thermal conduction in the longitudinal direction and allows easy conduction of heat in the longitudinal direction. Even in the case of the mode of continuously passing sheets 8 of a size smaller than the maximum width of paper passage, therefore, the heat in the paper non-contacting area is conducted via the heat-diffusing member 4 to the paper contacting area and consequently the difference between the temperature of the fixing sleeve 5 in the paper contacting area and the temperature thereof in the paper non-contacting area is decreased. Thus, the rise of temperature in the paper non-contacting area is diminished and the uneven temperature distribution of the fixing sleeve 5 in the longitudinal direction is repressed. As a result, the possibility that such peripheral members as the separation claw 45 made of a resinous material will suffer a decrease in the heat life and sustain thermal damage is nil. Further, the evenness of the fixing property is not exposed to partial disruption and the high-temperature offset is precluded even when the supply of other sheets of a large size is started immediately after the mode.

As described above, the fifth embodiment curbs the uneven temperature distribution of the heated fixing sleeve 5 in the longitudinal direction thereof and realizes the stabilization of the fixing property in all the modes of paper passage.

Sixth embodiment

Figure 14:
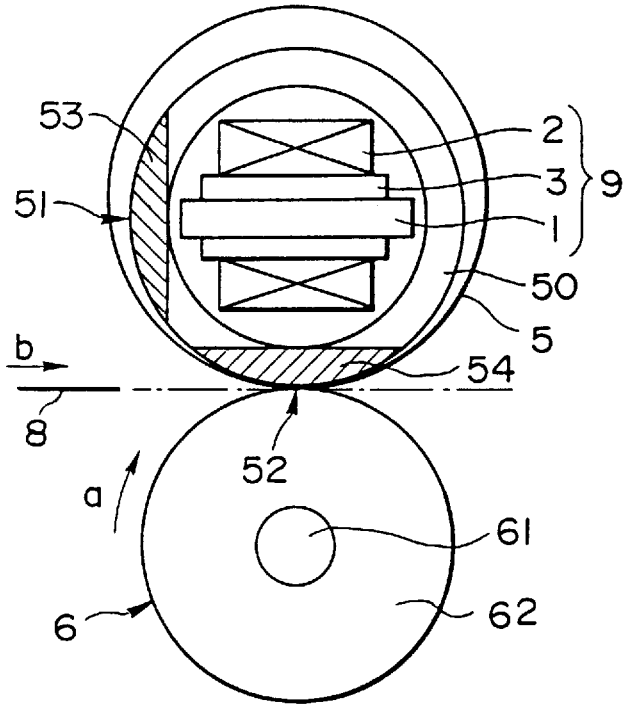
FIG. 14 and FIG. 15 are structural diagrams illustrating an induction heating type fixing apparatus as the sixth embodiment provided with a plurality of heat-diffusing members.
Figure 15:
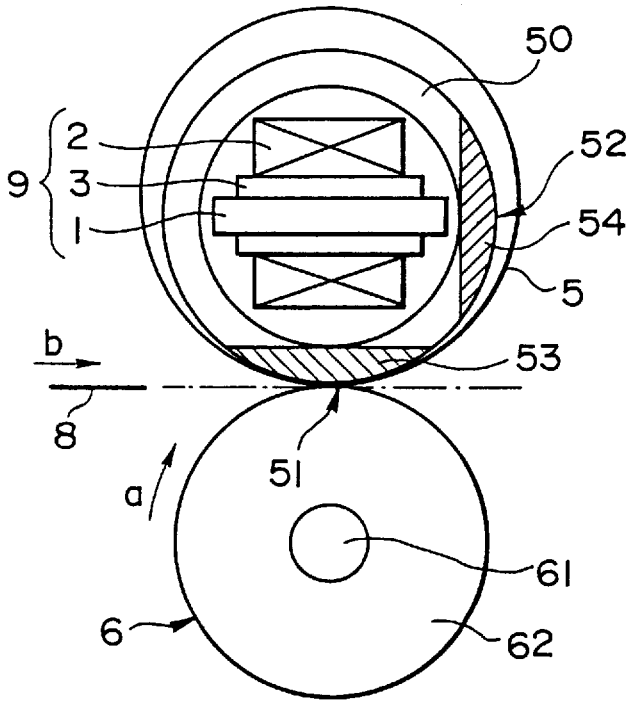

FIGS. 14 and 15 are structural diagrams illustrating an induction heating type fixing apparatus as the sixth embodiment. In these diagrams, like components found in the fifth embodiment are denoted by like reference numerals. These components will be omitted from the following description. The separation claw 45, the thermistor 7, and the thermostat 23 will be omitted from FIGS. 14 and 15.

The sixth embodiment, like the fifth embodiment, consists in an induction heating type fixing apparatus using a fixing sleeve 5. It differs from the fifth embodiment in respect that a holder 50 is provided with a plurality of nipping parts 51 and 52.

The induction heating type fixing apparatus according to the sixth embodiment is, as shown in FIGS. 14 and 15, likewise provided with the coil assembly 9, the fixing sleeve 5, the holder 50 adapted to accept the fixing sleeve 5 into sliding contact therewith, and the pressing roller 6.

The holder 50 of the sixth embodiment is specifically provided with two nipping parts 51 and 52 adapted to be freely switched. The nipping parts 51 and 52 are provided respectively with a first and a second heat-diffusing member 53 and 54 which are made of a material with good thermal conductivity characteristics and laid along the longitudinal direction of the holder 50. Further, the thermal conductivity of the first heat-diffusing member 53 and the thermal conductivity of the second heat-diffusing member 54 are differentiated.

Since the fixing apparatus of the sixth embodiment is based on the method of induction heating, the heat-diffusing members 53 and 54 are formed of a material which is additionally endowed with the non-magnetic properties. The first and the second heat-diffusing member 53 and 54 are identical in structure and in specific material with the heat-diffusing member of the first embodiment, they will be omitted from the following description.

To differentiate the first and the second heat-diffusing member 53 and 54 in thermal conductivity, the heat-diffusing members 53 and 54 are formed of materials having different coefficient of thermal conductivity. For example, copper is used as the material for the first heat-diffusing member 53 and aluminum as the material for the second heat-diffusing member 54. Since copper has larger coefficient of thermal conductivity than aluminum, the second heat-diffusing member 54 has lower thermal conductivity than the first heat-diffusing member 53.

Figure 16:
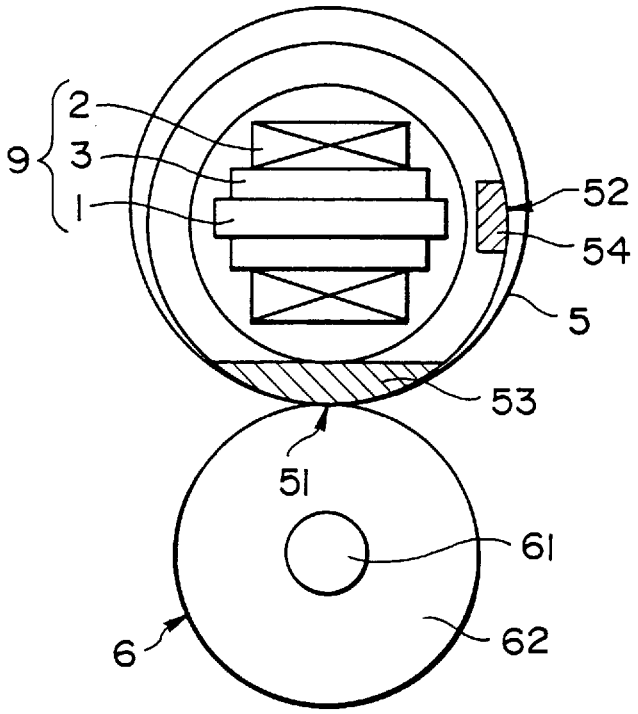
FIG. 16 is a structural diagram illustrating one example of the structure of a plurality of heat-diffusing members varied in thermal conductivity.

The number of nipping parts that are freely switched is not limited to 2 but may be changed to 3 or 4. As mentioned-above, the thermal conductivity is affected by both the coefficient of thermal conductivity and the cross-sectional area. When one and the same material is used for both the heat-diffusing members 53 and 54, the differentiation of thermal conductivity can be accomplished by differentiating the heat-diffusing members 53 and 54 in cross-sectional area as illustrated in FIG. 16.

Figure 17:
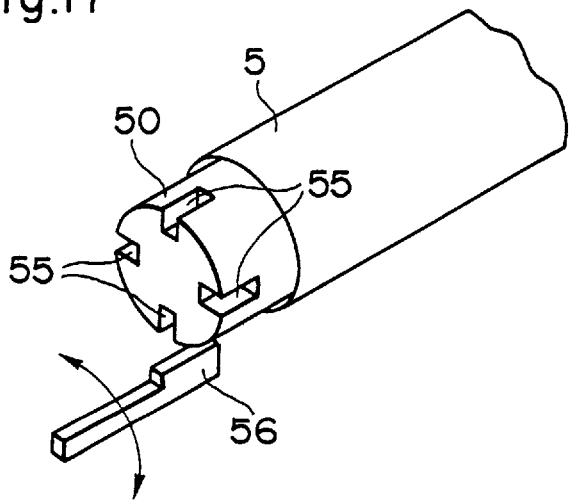
FIG. 17 is a perspective view illustrating the essential part of a holder in the sixth embodiment.

The holder is not rotated while the normal printing is in process, and is allowed to rotate freely when the two nipping parts 51 and 52 are selectively switched. As conceptually illustrated in FIG. 17, grooves 55 are formed in the end part of the holder 50 and claw parts 56 adapted to be engaged with the grooves 55 are swingably disposed on the apparatus proper. The holder 50 assumes the state of no rotation when the claw parts 56 are engaged with the grooves 55 and the holder 50 assumes the state of free rotation when the claw parts 56 are oscillated and released from the grooves 55. When the holder 50 is set at the state of free rotation and the pressing roller 6 is set rotating, the holder 50 follows the rotation of the fixing sleeve 5. When the fact that the holder 50 has been rotated to a prescribed angle is detected based on, for example, the amount of the rotation of the pressing roller 6, the claw parts are oscillated and brought into engagement with the grooves 55. Thus, the holder 50 allows the nipping parts 51 and 52 to be selectively switched and ultimately set in the state of no rotation. When the holder 50 is adapted to rotate by following the rotation of the pressing roller 6 as described above, the drive means otherwise necessary for the purpose of rotating the holder 50 can be omitted and the cost inevitably incurred consequently can be saved.

Since the density of the magnetic fluxes which pass through the fixing sleeve 5 is maximum in the part opposite the induction coil 2 and the local heat generation occurs in this part, the direction and other matters of the induction coil 2 are so set that the part of heat generation and the nipping parts may overlap at least partly. The coil assembly 9, therefore, retains the state of no rotation even when the holder 50 is rotated for switching the nipping parts 51 and 52.

Now, the operation of the present embodiment will be described below.

In the sixth embodiment, the switch between the two nipping parts 51 and 52 is effected based on the question as to whether or not the warm-up of the fixing sleeve 5 has been completed.

Figure 18:
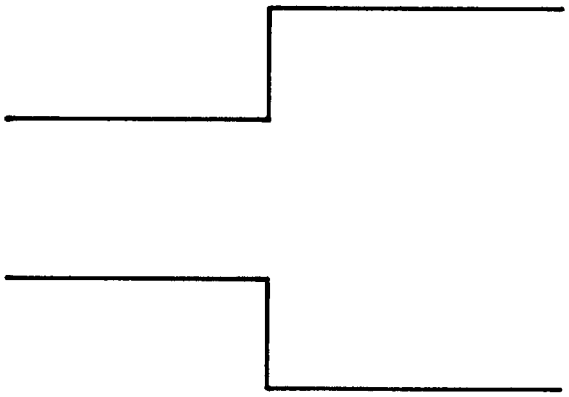
FIG. 18 is a timing chart to aid in the description of a switching operation of the nipping part in the sixth embodiment.

FIG. 18 is a timing chart to aid in the description of a switching operation of the nipping parts in the sixth embodiment. Until the warm-up of the fixing sleeve 5 is completed, the second heat-diffusing member 54 which has lower thermal conductivity is positioned opposite the pressing roller 6 as shown in FIG. 14.

When the high-frequency current is supplied to the induction coil 2 in the subsequent state, the second heat-diffusing member 54 which is made of a non-magnetic material generates an induced current with difficulty and hardly emits heat, while the fixing sleeve 5 which is made of a magnetic metallic material produces an induced high-frequency current, emits heat, and brings about a quick rise of temperature.

When the fixing sleeve 5 generates heat to the prescribed temperature, the claw part 56 is oscillated and caused to break engagement with the groove 55 in the holder 50 and set the holder 50 at the state of free rotation. Then, the pressing roller 6 is set rotating and the holder 50 is caused to rotate by following the rotation of the fixing sleeve 5. When the first heat-diffusing member 53 which has higher thermal conductivity reaches the nipping position opposite the pressing roller 6, the pressing roller 6 is caused to cease rotation and the claw part 56 is oscillated and engaged with the groove 55. Thus, the holder 50 switches the nipping parts 51 and 52 and assumes the state of no rotation and the first heat-diffusing member 53 proceeds to confront the nipping position as illustrated in FIG. 15.

Since the first heat-diffusing member 53 has higher thermal conductivity than the second heat-diffusing member 54, the fixing sleeve 5 enjoys an exalted thermal conduction in the longitudinal direction and allows easy conduction of heat in the longitudinal direction. Thus, the heat in the paper non-contacting area is conducted through the first heat-diffusing member 53 to the paper contacting area and, as in the fifth embodiment, the uneven temperature distribution in the fixing sleeve 5 in the longitudinal direction can be repressed and the possibility of the peripheral members suffering a decrease in the heat life and sustaining thermal damage can be eliminated even in the case of the mode of continuously supplying sheets 8 of a size smaller than the maximum width of paper passage. Moreover, the evenness of the fixing property cannot be exposed to partial disruption even when the supply of other sheets of a larger size is started immediately after the mode.

In the sixth embodiment, since the second heat-diffusing member 54 having smaller thermal conductivity is retained opposite the nipping position until the warm-up is completed as described above, the quick rise of temperature of the fixing sleeve 5 is not obstructed. The first heat-diffusing member 53 having higher thermal conductivity is switched to the nipping position after the warm-up is completed. The rise of temperature in the paper non-contacting area is diminished and the uneven temperature distribution of the fixing sleeve 5 in the longitudinal direction is advantageously repressed in conformity with the change of use condition of the fixing apparatus, depending on whether or not the warm-up is completed. The fixing apparatus, therefore, is allowed to manifest a stable fixing property in any of the modes of paper passage.

Seventh embodiment

The seventh embodiment to be described below and the eighth embodiment to be subsequently described differ from the sixth embodiment in respect that the timing for switching the two nipping parts 51 and 52 is modified. Since the structure of the fixing apparatus in the present embodiment is identical with that in the sixth embodiment, it will be omitted from the following description.

In the seventh embodiment, the switching of the two nipping parts 51 and 52 is effected based on the question whether or not the continuous supply of a prescribed number of sheets has been completed. Thus, the switching motion is initiated on the basis of the signal from a print counter which plays the role of counting the number of sheets supplied continuously. The print counter may be installed on the fixing apparatus side. It may be otherwise installed on the side of such an image forming apparatus as a printer which incorporates the fixing apparatus therein.

Figure 19:
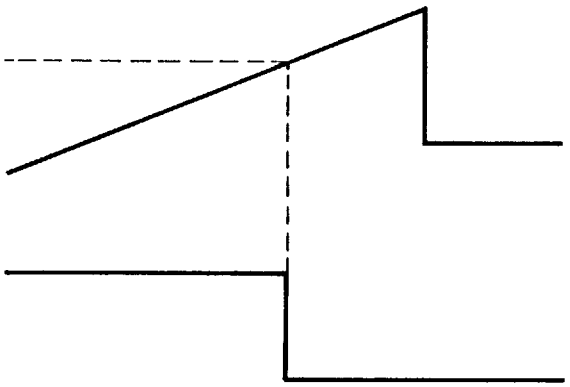
FIG. 19 is a timing chart in the seventh embodiment having the switching operation of the nipping part varied.

FIG. 19 is a timing chart to aid in the description of the operation for switching the nipping part in the seventh embodiment. At first, the second heat-diffusing member 54 which has smaller thermal conductivity is disposed at the nipping position.

When the warm-up of the fixing sleeve 5 is completed and the continuous printing operation is initiated, the number of sheets is counted by the print counter. Since the voltage applied to the induction coil 2 remains at an elevated level during the continuous printing, the uneven temperature distribution of the fixing sleeve 5 in the longitudinal direction tends to be aggravated.

When the number of continuously produced prints surpasses the prescribed sum, the nipping parts 51 and 52 are switched by the oscillation of the claw part 56 and the driven rotation of the holder 50 and the first heat-diffusing member 53 having larger thermal conductivity is caused to confront the nipping position.

Consequently, the heat in the paper non-contacting area is conducted through the first heat-diffusing member 53 to the paper contacting area and, as in the fifth embodiment, the uneven temperature distribution in the fixing sleeve 5 in the longitudinal direction can be repressed and the possibility of the peripheral members suffering a decrease in the heat life and sustaining thermal damage can be eliminated even in the case of the mode of continuously supplying sheets 8 of a size smaller than the maximum width of paper passage. Moreover, the evenness of the fixing property cannot be exposed to partial disruption even when the supply of sheets of a larger size is started immediately after the said mode.

Even after the continuous printing operation is completed, the state in which the first heat-diffusing member 53 is retained opposite the nipping position is continued for a prescribed length of time for the purpose of relieving the fixing sleeve 5 of the uneven temperature distribution in the longitudinal direction.

In the seventh embodiment, since the first heat-diffusing member 53 having larger thermal conductivity is switched to the nipping position when the printing operation is continued until the prescribed number of prints is surpassed as described above, the rise of temperature in the paper non-contacting area is diminished and the uneven temperature distribution of the fixing sleeve 5 in the longitudinal direction is repressed advantageously in conformity with the change of use condition of the fixing apparatus, depending on whether or not the warm-up is completed. The fixing apparatus, therefore, is allowed to manifest a stable fixing property in any of the modes of paper passage.

Eighth embodiment

In the eighth embodiment, the switching of the two nipping parts 51 and 52 is implemented based on the size of the sheet 8. The signal concerning the sheet size is inputted from the image forming apparatus side.

Figure 20A:
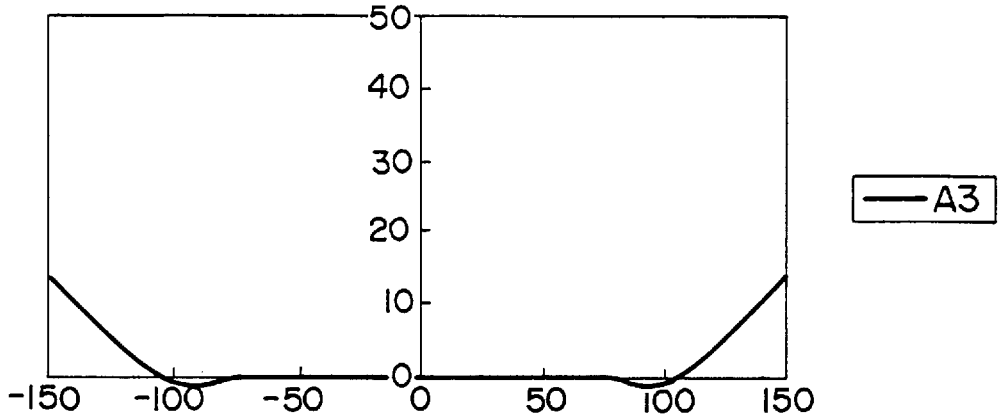
FIGS. 20A, 20B, and 20C are graphs showing the temperature distribution in the longitudinal direction of the fixing sleeve when the second heat-diffusing member made of aluminum is caused to confront the nipping position in the eighth embodiment having the switching motion of the nipping part further varied, respectively using sheets of A3 size, A4 size, and A5 size for continuous passage.
Figure 20B:
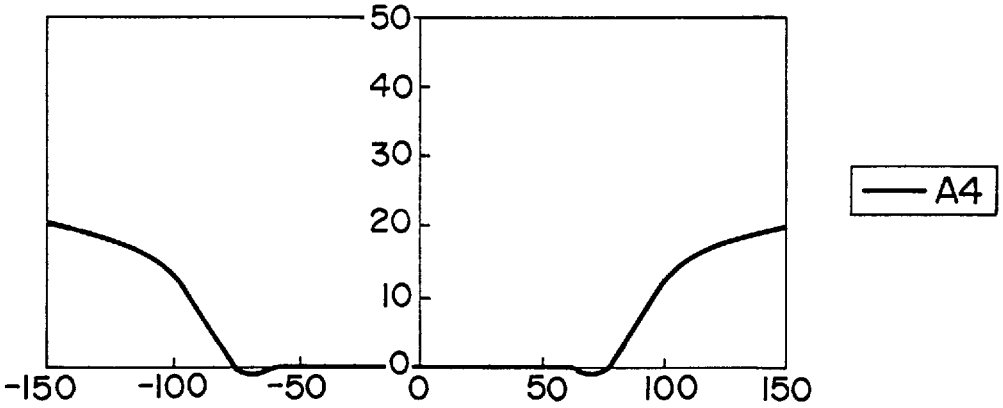
Figure 20C:
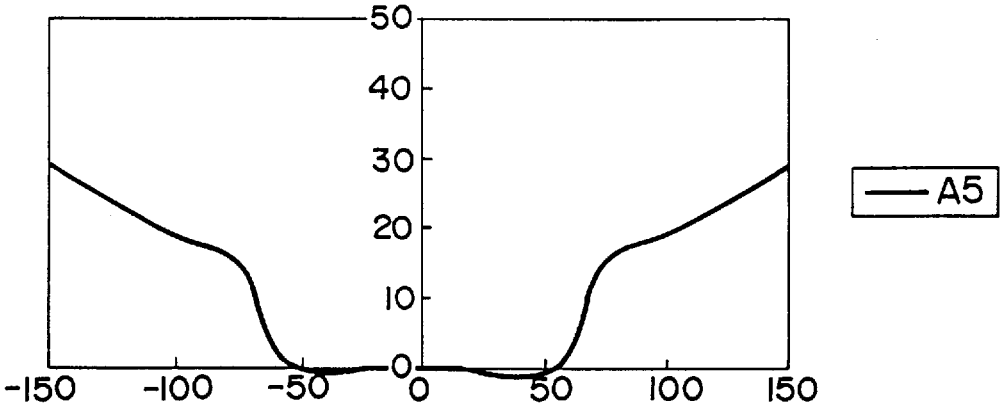
Figure 21A:
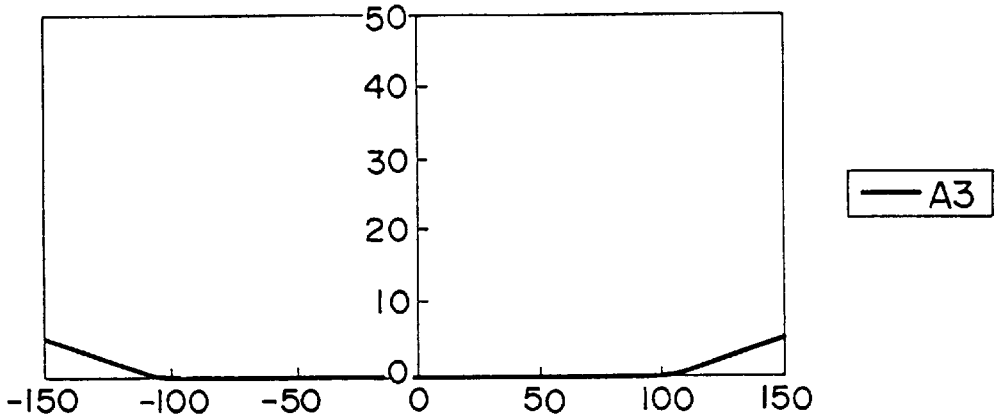
FIGS. 21A, 21B, and 21C are graphs showing the temperature distribution in the longitudinal direction of the fixing sleeve when the first heat-diffusing member made of copper is caused to confront the nipping position in the eighth embodiment, respectively using sheets of A3 size, A4 size, and A5 size for continuous passage.
Figure 21B:
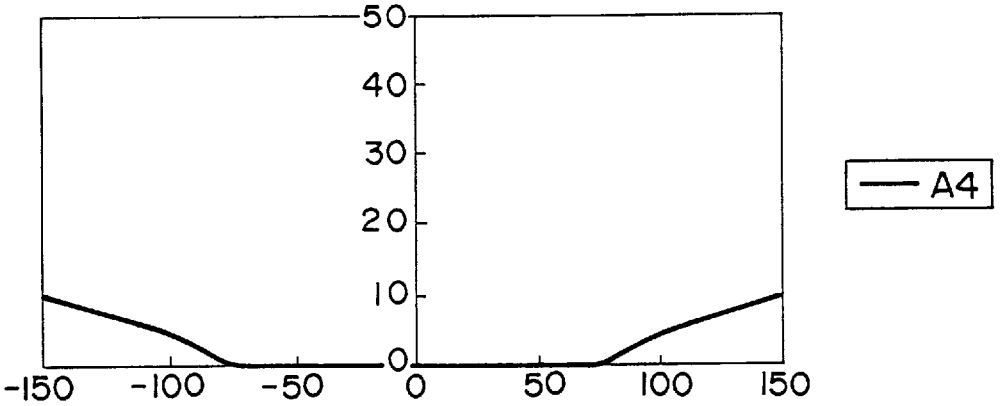
Figure 21C:
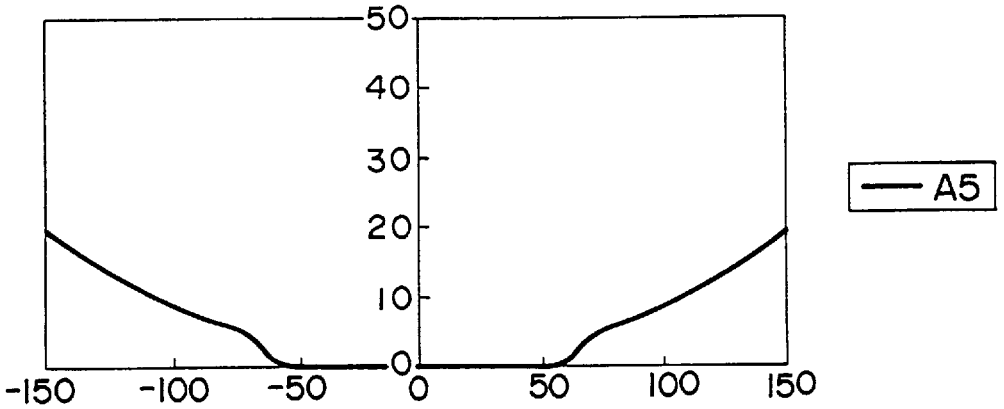

FIGS. 20A, 20B and FIG. 20C are graphs showing the temperature distribution in the longitudinal direction of the fixing sleeve 5 obtained when the second heat-diffusing member 54 made of aluminum is caused to confront the nipping position, respectively using sheets of A3 size, A4 size, and A5 size for continuous passage. FIGS. 21A, 21B and 21C are graphs showing the temperature distribution in the longitudinal direction of the fixing sleeve 5 obtained when the first heat-diffusing member 53 made of copper is caused to confront the nipping position, respectively using sheets of A3 size, A4 size, and A5 size for continuous passage. In each of the graphs, the horizontal axis is the scale of the distance (mm) from the central position in the longitudinal direction of the fixing sleeve and the vertical axis the scale of the rise (°C.) from the prescribed level (for example, 150°~200° C.).

When the second heat-diffusing member 54 made of aluminum is made to confront the nipping position, the difference between the temperature of the fixing sleeve 5 in the paper contacting area and the temperature thereof in the paper non-contacting area is repressed to the practically allowable level of not more than 20° C. after the continuous supply of sheets 8 of the A3 size and the A4 size as shown in FIG. 20A and FIG. 20B. It is noted from FIG. 20C, however, that the difference of temperature surpasses 20° C. and the uneven temperature of the fixing sleeve 5 in the longitudinal direction gains in prominence when the sheets 8 of the A5 size are supplied continuously.

When the first heat-diffusing member 53 made of copper and having larger thermal conductivity than the second heat-diffusing member 54 is made to confront the nipping position, the difference between the temperature of the fixing sleeve 5 in the paper contacting area and the temperature thereof in the paper non-contacting area can be repressed to the practically allowable level of not more than 20° C. not only after the continuous supply of sheets 8 of the A3 size and the A4 size but also after the continuous supply of sheets 8 of the A5 size as noted from FIGS. 21A, 21B and 21C.

In due observance of the results described above, the eighth embodiment causes the second heat-diffusing member 54 having smaller thermal conductivity to confront the nipping position during the passage of sheets 8 of the A3 size and the A4 size and causes the first heat-diffusion member 53 having larger thermal conductivity to confront the nipping position by switching the nipping parts 51 and 52 owing to the oscillation of the claw part 56 and the driven rotation of the holder 50 during the passage of sheets 8 of the A5 size, a smaller size.

Since the first heat-diffusing member 53 has larger thermal conductivity than the second heat-diffusing member 54, the fixing sleeve 5 easily conducts heat in the longitudinal direction. Even in the case of the mode of continuously supplying sheets 8 of the A5 size, therefore, the heat in the paper non-contacting area is conducted through the first heat-diffusing member 53 to the paper contacting area and the uneven temperature distribution of the fixing sleeve 5 in the longitudinal direction can be repressed to below the practically allowable level of not more than 20° C. As a result, the possibility of the peripheral members suffering a decrease in the heat life and sustaining thermal damage is eliminated and the evenness of the fixing property is not exposed to partial disruption even when the supply of sheets 8 of the A3 size and the A4 size is initiated immediately after the mode.

For the purpose of accomplishing the quick temperature rise during the warm-up of the fixing sleeve 5, it is advisable as in the case of the sixth embodiment to set the second heat-diffusing member 54 having smaller thermal conductivity at the position opposite the nipping position. Then, after the warm-up of the fixing sleeve 5 is completed, the first heat-diffusing member 53 or the second heat-diffusing member 54 is selectively set at the nipping position by switching the nipping parts 51 and 52 depending on the size of the sheet 8 as described above.

When the continuous printing operation is actuated, it is appropriate as in the case of the seventh embodiment to set the first heat-diffusing member 53 having larger thermal conductivity at the nipping position no matter whether the sheets 8 are of the A3 size or the A4 size.

In the eighth embodiment, since the nipping parts 51 and 52 are switched depending on the size of the sheets 8 to be supplied, the rise of temperature in the paper non-contacting area is diminished and the uneven temperature distribution of the fixing sleeve 5 in the longitudinal direction is repressed advantageously in conformity with the change of use condition of the fixing apparatus, depending on the change in size of the sheets 8 to be supplied. The fixing apparatus, therefore, is allowed to manifest a stable fixing property in any of the modes of paper passage.

The sixth embodiment, the seventh embodiment and the eighth embodiment represent the cases of using fixing apparatus of the method of induction heating utilizing the induction coil 2 as the heat source. The method of heating contemplated by this invention is not limited to that of induction heating. The method of heating by the use of an electric heater or a tungsten halogen lamp as the heat source is allowable on the condition that it is capable of effectively heating a freely movable heating element of a small section thickness. The heating element is not limited by the shape of the fixing sleeve 5. Various freely movable forms such as that of a belt may be adopted for the heating element.

What is claimed is:

1. A fixing apparatus for causing a toner deposited on a sheet to be thermally fused and fixed on said sheet, comprising:

a thin sleeve with flexibility composed of a base layer and a surface layer touching to said sheet, at least said surface layer is made of metal, a coil adapted to generate a magnetic field in response to a high-frequency current supplied from a current supplying means and to produce an induced eddy current in said sleeve to generate heat therein, a retaining member adapted to retain said coil and disposed stationarily in said sleeve, pressing means pressed against said retaining member through said sleeve and enabled to nip said sheet carrying an unfixed toner thereon in cooperation with said sleeve and to move said sheet together with said sleeve, and at least a first heat-diffusing member extended in a direction perpendicular to a direction of conveyance of said sheet and formed of a material with good thermal conductivity characteristics and non-magnetic properties, said first heat-diffusing member disposed in said sleeve so as to contact said sleeve at a contact part between said sleeve and said pressing means.

2. A fixing apparatus according to claim 1, wherein said heat-diffusing member is disposed on said retaining member.

3. A fixing apparatus according to claim 1, further comprising;

a second heat-diffusing member having smaller thermal conductivity than said heat-diffusing member and control means for selectively switching the positions of said first and second heat-diffusing members thereby enabling either of said first and second heat-diffusing members to contact said sleeve at the contact part between said sleeve and said pressing means.

4. A fixing apparatus according to claim 3, wherein said control means switches the position of said first and second heat-diffusing members based on the temperature of said sleeve.

5. A fixing apparatus according to claim 4, wherein said control means sets said second heat-diffusing member at the contact position with said sleeve until the temperature of said sleeve reaches a prescribed level and sets said first heat-diffusing member at said position after said sleeve reaches said prescribed temperature.

6. A fixing apparatus according to claim 3, wherein said control means switches the positions of said first and second heat-diffusing members based on the total number of said sheets to be continuously supplied.

7. A fixing apparatus according to claim 6, wherein said control means sets said second heat-diffusing member at the contact position with said sleeve when the number of continuously supplied sheets is less than a prescribed sum and sets said first heat-diffusing member at said position when said number surpasses said sum.

8. A fixing apparatus according to claim 3, wherein said control means switches the positions of said first and second heat-diffusing members based on the size of said sheet.

9. A fixing apparatus according to claim 8, wherein said control means sets said first heat-diffusing member at the contact position with said sleeve when said sheets have a size smaller than a prescribed size and sets said second heat-diffusing member at said position when said sheets have a size larger than said prescribed size.

10. A fixing apparatus according to claim 3, wherein said first and second heat-diffusing members are disposed on said retaining member.

11. A fixing apparatus for causing a toner deposited on a sheet to be thermally fused and fixed on said sheet, comprising;

a heating element formed of a flexible material of a small section thickness, a heat source for heating said heating element, a retaining member adapted to retain said heat source and disposed stationarily, pressing means pressed against said retaining member through said heating element and adapted to nip a sheet carrying an unfixed toner in cooperation with said heating element and advance said sheet together with said heating element, a first heat-diffusing member made of a material with good thermal conductivity characteristics and extended in a direction perpendicular to the direction of conveyance of said sheet, a second heat-diffusing member possessing smaller thermal conductivity than said first heat-diffusing member and extended in a direction perpendicular to the direction of conveyance of said sheet, and control means for selectively switching the positions of said first and second heat-diffusing members thereby causing either of said first and second heat-diffusing members to contact said heating element at the contact part between said heating element and said pressing means.

12. A fixing apparatus according to claim 11, wherein said control means switches the positions of said first and second heat-diffusing members based on the temperature of said heating element.

13. A fixing apparatus according to claim 12, wherein said control means sets said second heat-diffusing member at the contact position with said heating element until the temperature of said heating element reaches a prescribed level and sets said first heat-diffusing member at said position after said heating element reaches said prescribed temperature.

14. A fixing apparatus according to claim 11, wherein said control means switches the positions of said first and second heat-diffusing members based on the number of continuously supplied sheets.

15. A fixing apparatus according to claim 14, wherein said control means sets said second heat-diffusing member at the contact position with said heating element when the number of continuously supplied sheets is less than a prescribed sum and sets said first heat-diffusing member at said position when said number surpasses said sum.

16. A fixing apparatus according to claim 11, wherein said control means switches the positions of said first and second heat-diffusing members based on the size of said sheet.

17. A fixing apparatus according to claim 16, wherein said control means sets said first heat-diffusing member at the contact position with said heating element when said sheets have a size smaller than a prescribed size and sets said second heat-diffusing member at said position when said sheets have a size larger than said prescribed size.

18. A fixing apparatus according to claim 11, wherein said first and second heat-diffusing members are disposed on said retaining member.

* * * * *

UNITED STATES PATENT AND TRADEMARK OFFICE

CERTIFICATE OF CORRECTION

PATENT NO. : 5,839,043

DATED : November 17, 1998

INVENTOR(S) : Okabayashi et al.

It is certified that error appears in the above-identified patent and that said Letters Patent is hereby corrected as shown below:

On the cover page of the issued patent, Under Inventors, "Taizou Oonishi, both" should be deleted.

Signed and Sealed this

Eighteenth Day of May, 1999

*Attest:*

*Attesting Officer*

Q. TODD DICKINSON

*Acting Commissioner of Patents and Trademarks*